US009051833B2

(12) United States Patent
Diggs

(10) Patent No.: US 9,051,833 B2
(45) Date of Patent: Jun. 9, 2015

(54) X-ENGINE ASSEMBLY WITH PERFECT BALANCE

(76) Inventor: Matthew Byrne Diggs, Farmington, MI (US)

( * ) Notice: Subject to any disclaimer, the term of this patent is extended or adjusted under 35 U.S.C. 154(b) by 454 days.

(21) Appl. No.: 13/521,312

(22) PCT Filed: Aug. 29, 2011

(86) PCT No.: PCT/US2011/049492

§ 371 (c)(1),
(2), (4) Date: Jul. 10, 2012

(87) PCT Pub. No.: WO2013/032431

PCT Pub. Date: Mar. 7, 2013

(65) Prior Publication Data

US 2013/0098335 A1 Apr. 25, 2013

(51) Int. Cl.

| | |
|---|---|
| ***F01B 7/16*** | (2006.01) |
| ***F01B 15/02*** | (2006.01) |
| ***F01B 9/02*** | (2006.01) |
| *F02B 75/22* | (2006.01) |

(52) U.S. Cl.

CPC . *F01B 15/02* (2013.01); *F01B 7/16* (2013.01); *F01B 9/023* (2013.01); *F02B 75/227* (2013.01)

(58) Field of Classification Search

CPC ..... F01B 15/02; F01B 9/02; F01B 9/023; F01B 9/026; F01B 7/16; F02B 75/22

USPC ..... 123/45 R, 53.6, 54.1, 55.2, 192.1, 192.2

See application file for complete search history.

(56) References Cited

U.S. PATENT DOCUMENTS

| | | | | |
|---|---|---|---|---|
| 1,708,901 | A | | 4/1929 | Royce |
| 2,076,892 | A | | 4/1937 | Irgens |
| 4,339,988 | A | * | 7/1982 | Steele ..... 91/493 |
| 4,512,291 | A | * | 4/1985 | Kirk ..... 123/54.2 |
| 4,559,838 | A | * | 12/1985 | Neuenschwander ..... 74/50 |
| 4,850,313 | A | | 7/1989 | Gibbons |
| 4,940,026 | A | * | 7/1990 | Fisher ..... 123/55.4 |
| 5,503,038 | A | * | 4/1996 | Aquino et al. ..... 74/49 |
| 5,560,327 | A | * | 10/1996 | Brackett ..... 123/55.7 |
| 5,782,213 | A | * | 7/1998 | Pedersen ..... 123/55.2 |
| 5,873,339 | A | * | 2/1999 | Isogai ..... 123/197.4 |
| 6,213,064 | B1 | * | 4/2001 | Geung ..... 123/54.1 |
| 7,191,742 | B2 | * | 3/2007 | Fuchs et al. ..... 123/55.2 |

(Continued)

FOREIGN PATENT DOCUMENTS

| | | |
|---|---|---|
| DE | 44 14 769 A1 | 11/1995 |
| EP | 0 187 930 A2 | 7/1986 |

(Continued)

*Primary Examiner* — Lindsay Low
*Assistant Examiner* — Grant Moubry
(74) *Attorney, Agent, or Firm* — Peter J. Rashid

(57) ABSTRACT

An X-Engine assembly includes four cylinder banks which are located on two intersecting planes with the crankshaft axis being on the line of the intersection of the two planes, and having a Double-Acting Scotch Yoke (DASY) power conversion system that couples the reciprocating motion of the pistons with the rotating crankshaft to provide pure sinusoidal piston motion. A series of DASY X-Engine configurations that satisfy even-firing for both 2-stroke and 4-stroke, and other engine cycles, achieve perfect balance with regard to vibrating forces and moments that are all zero, and all configurations have zero torsional vibration of the crankshaft resulting from the reciprocating masses.

10 Claims, 20 Drawing Sheets

(56) References Cited

U.S. PATENT DOCUMENTS

| | | | | |
|---|---|---|---|---|
| 7,373,905 | B2 | 5/2008 | Fuchs et al. | |
| 7,721,684 | B2 * | 5/2010 | Schmied | 123/42 |
| 8,375,919 | B2 * | 2/2013 | Cook et al. | 123/197.4 |
| 2002/0038644 | A1 * | 4/2002 | Korenjak | 123/192.2 |
| 2007/0209616 | A1 | 9/2007 | Fuchs et al. | |

FOREIGN PATENT DOCUMENTS

| | | | |
|---|---|---|---|
| GB | 10144 | A | 0/1911 |
| WO | 90/14501 | A1 | 11/1990 |
| WO | 2012/003171 | A1 | 1/2012 |

* cited by examiner

FIG. 4(a)
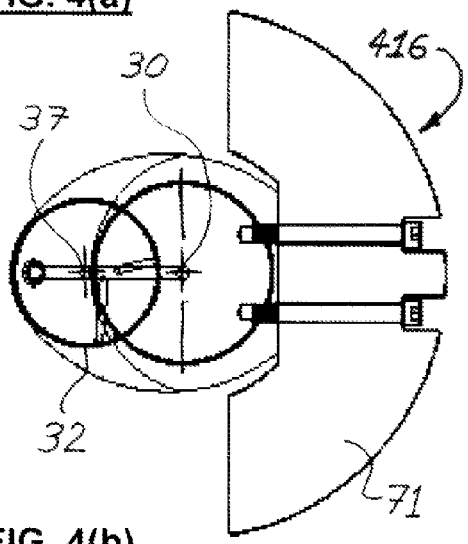
FIG. 4(b)
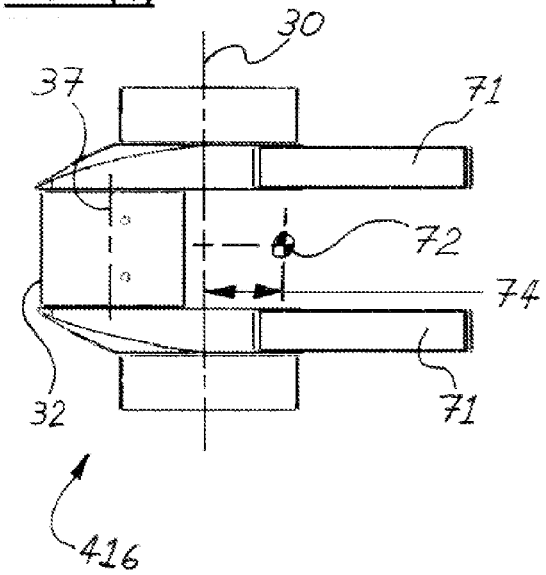
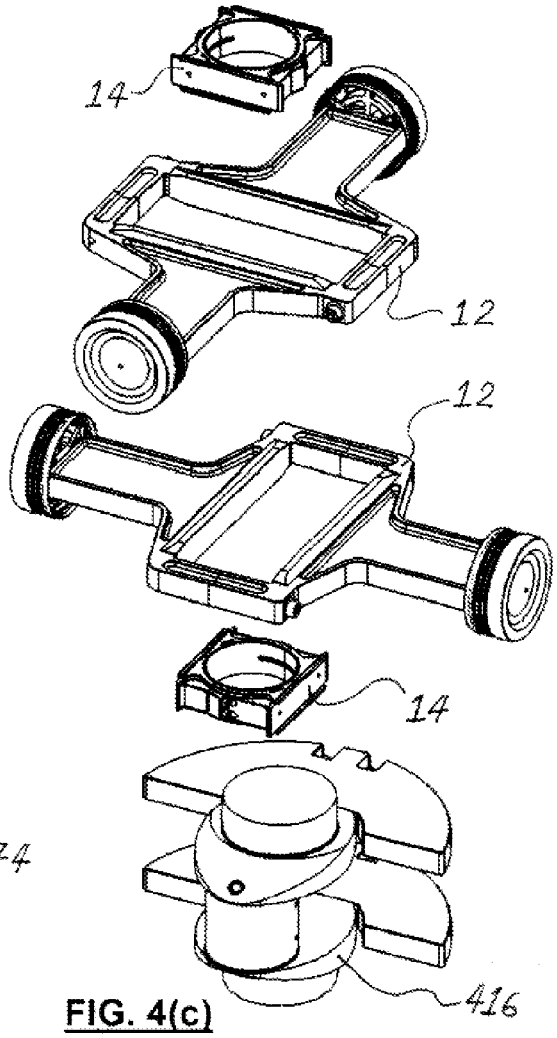
FIG. 4(c)
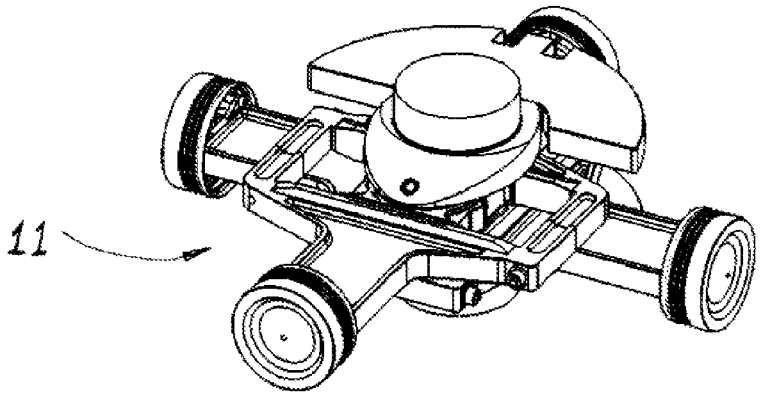
FIG. 4(d)

X-ENGINE ASSEMBLY WITH PERFECT BALANCE

CLAIM TO PRIORITY

This application is a National stage application of PCT Application No. PCT/US11/49492, filed on Aug. 29, 2011, the entire contents of both are incorporated herein by reference.

BACKGROUND OF THE INVENTION

The invention relates generally to internal combustion piston engines, fluid pumps and similar machines and, more particularly to an X-Engine configuration.

The objective of an engine designer is to provide the best function with regards to performance and efficiency, while also minimizing the amount of noise and vibration that emanate from the engine. It is also desirable to provide an engine that is the smallest, lightest-weight while having a design which can be economically manufactured and serviced.

The most widely used engine configurations in use and today are in-line, "V" and horizontally-opposed or 'flat'. Almost all of these engines use conventional connecting rods ("con rods") in the power conversion system. Con rods, due to the complex nature of their motion, produce multiple orders of vibration such that there is no practical way to cancel out all of the resultant vibration in an engine that has con rods. Some conventional engine configurations which use con rods, such as the 90° V-8 and the in-line-four cylinder with dual $2^{nd}$-order balancers, have balance for $1^{st}$-order and $2^{nd}$-order vibrations, but practically all engines with conventional con rods are never balanced for $3^{rd}$-order vibrations and above. Furthermore, as the engine runs con rods induce torsional loads on the crankshaft that typically are not fully resolved as a result of the engines' configuration or from the use of extra balancing mechanisms.

The Scotch yoke is a mechanism for converting the linear motion of a slider into rotational motion of a shaft or vice-versa, and has been demonstrated to be suitable for use in internal combustion piston engines. The piston or other reciprocating part is directly coupled to a sliding yoke with a slot that engages a pin on the rotating crankshaft, with a bearing block is fitted in between the crankshaft and the yoke to provide a cylindrical-cylindrical interface at the crankpin and flat-on-flat interface with the yoke so that the contact pressures at both interfaces are at acceptable levels. The shape of the motion of the piston is a pure sine wave over time given a constant rotational speed of the crankshaft.

So, unlike conventional engine configurations in use today, the scotch yoke mechanism is a mechanism that couples the reciprocating pistons to the rotating crankshaft with true harmonic motion for the reciprocating mass, assuming a constant rotational speed of the crankshaft, such that an engine that uses scotch yokes can be said to be "100% balanced for all orders" or "perfectly balanced" if it is balanced for $1^{st}$-order forces and moments.

With regards to reducing friction in an engine, the scotch yoke mechanism can be used in a double-ended or "double-acting" fashion such that each reciprocating assembly has a piston at either end, hence a benefit of the double-acting scotch yoke is that the fluid motion inside the crankcase is reduced because opposite pistons simply push air in between them, whereas in "V"-type engines and in-line engines there is a larger mass of fluid in motion inside the crankcase which is pushed out of the cylinders and around the engine's bulkheads in a way that causes larger amounts of fluid friction and necessitates having an empty volume in the engine crankcase to allow this fluid motion to occur. So, it can be seen that the Double-Acting Scotch Yoke system can provide an engine with reduced friction which translates to better fuel efficiency and better performance.

Another capability of the Double-Acting Scotch Yoke is that it can be used in an X-engine configuration having two reciprocating assemblies for a total of four pistons coupled to each crankpin bearing on the crankshaft in a similar way to the conventional connecting rod as it is used in V-configuration engines which have two con rod and piston assemblies coupled to each crankpin bearing on the crankshaft. By doubling the number of cylinders coupled to each crankpin bearing, and having no requirement to allow large amounts of fluid motion to pass across the main bearing support structure as the engine runs, the Double-Acting Scotch Yoke used in X-configuration can result in a significantly smaller and lower mass engine for a given bore & stroke and number of cylinders when compared with in-line, "V" and flat engine configurations.

It should also be noted that a radial engine that employs a master con rod with secondary con rods attached to it is an arrangement which allows multiple cylinders of an engine to be attached to a single crankpin bearing, but the compromise here is that there are at least two different piston motions (piston displacement versus crankshaft angle) occurring in this type of engine, which greatly complicates any efforts to achieve balance of even the $1^{st}$-order of vibration. Hence, there is no practical method to have $1^{st}$ and $2^{nd}$ order balance for a group of cylinders connected in this way. Furthermore, with the modern fuel injection systems used in engines now, having different piston motions would greatly complicate the calibration and emission-ability of such an engine.

Hence, the X-engine configuration using the double-acting scotch yoke—a mechanism that provides true 'harmonic motion'—has the potential to provide a superior result for many piston engine applications, which today are mostly "V", in-line, and flat engines that employ con rods.

SUMMARY OF THE INVENTION

An object of the invention is to provide a series of X-Engine configurations that achieve perfect balance—that is, zero vibrating forces or moments of any order (either $1^{st}$-order, $2^{nd}$-order or higher orders), and also have zero torsional loading on the crankshaft resulting from reciprocating masses. This is a better result than practically any engine in production today due to the fact that nearly all engines employ the connecting rod mechanism, which results in multiple orders of vibrating moments and forces and also torsional loading on the crankshaft for which there is no practical way to cancel or resolve.

In one aspect, the Double-Acting Scotch Yoke (DASY) X-Engine can be configured using a 90° X-angle such that a single-central crankshaft is surrounded by four banks of cylinders with all four banks of cylinders located on two planes which intersect at a 90° angle with the crankshaft axis on the line of intersection, and having the engine configured so that there are two reciprocating DASY assemblies with two pairs of opposing-pistons for a total of four pistons coupled to each crankpin on the crankshaft such that each crankpin is associated with a piston that is engaged with one cylinder of each of the four cylinder banks, and having a bank offset such that the two DASY assemblies coupled to each crankpin are offset along the axis of the crankshaft. The total number of cylinders is four times the number of crankpins. Perfect balance for some of these configurations is achieved inherently—that is, without the use of an extra balancing mechanism—by having the crankpins on the crankshaft in specific angular relations to one another. While having inherent balance, it will be shown that these configurations also achieve even-firing for either 4-stroke or 2-stroke or other engine cycles.

In a second aspect, a DASY X-Engine can be configured as just described, except having the crankpins on the crankshaft in any angular relation to one another, thus being able to satisfy more even-firing engines with the 4-stroke, 2-stroke or other engine cycles, and having a single counter-rotating $1^{st}$-order moment-balance shaft mounted on the engine structure in parallel to the crankshaft axis which, in every case, results in perfect balance. The total number of cylinders is four times the number of crankpins. Packaging of the balance shaft is made relatively simple due to the engine structure having four "valleys" between the four cylinder banks around the periphery of the engine each of which are suitable for mounting a balance shaft.

In a third aspect, the DASY X-Engine can be configured using a 90° X-angle as previously described, and having a crankshaft configured so that there is one reciprocating DASY assembly with two opposing pistons coupled to each crankpin on the crankshaft, thus also being able to satisfy more even-firing engines with the 4-stroke, 2-stroke or other engine cycles. The total number of cylinders is two times the number of crankpins. Perfect balance of these configurations can be achieved by having the crankpins on the crankshaft in specific angular relations to one another and having a single counter-rotating $1^{st}$-order moment-balance shaft mounted on the engine structure in parallel to the crankshaft axis.

Utilizing these first three aspects of the DASY X-Engine, it is found that a series of 90° X-engine configurations for the 4-stroke cycle having both even-firing and perfect balance can be achieved for eight-cylinders and larger in increments of four cylinders, hence X-8, X-12, X-16, X-20, etc.

Also utilizing these first three aspects of the DASY X-Engine, it is found that a series of 90° X-engine configurations for the 2-stroke cycle having both even-firing and perfect balance can be achieved for four-cylinders and larger in increments of four cylinders, hence X-4, X-8, X-12, X-16, etc.

Again utilizing these first three aspects of the DASY X-Engine, it is possible to have a series of engine configurations for the split cycle which is a combustion process whereby adjacent cylinders operate in pairs, with one cylinder firing and the other a support cylinder, having piston top-center events offset by relatively small crank-angle timing such as 20°. For the split cycle X-engine, with each of the four banks of cylinders consisting of one or more split cycle-cylinder pairs, it is found that a series of X-engine configurations having both even-firing and perfect balance can be achieved for eight-cylinders and larger in increments of eight cylinders, hence X-8, X-16, etc. It is understood that adjacent cylinders in the split cycle process have a port connecting the two cylinders, therefore the split cycle cylinder pairs are located along each of the four banks of the X-engine.—one pair per bank for the split cycle X-8, two pairs per bank for the split cycle X-16, etc.

In a fourth aspect, the Double-Acting Scotch Yoke (DASY) X-Engine can be configured using a non-90° X-angle such that there is the same less-than-90° angle between adjacent cylinder banks in two opposite corners, and the same more-than-90° angle between adjacent cylinder banks in the other two opposite corners, and having a crankshaft configured so that there is one or two reciprocating DASY assemblies coupled to each crankpin on the crankshaft. Perfect balance of these configurations can be achieved by having the crankpins on the crankshaft in specific angular relations to one another and having a single counter-rotating $1^{st}$-order moment-balance shaft mounted on the engine structure in parallel to the crankshaft axis.

Utilizing this fourth aspect of the DASY X-Engine it is found that a series of non-90° X-engine configurations for the 4-stroke cycle having both even-firing and perfect balance can be achieved for eight-cylinders and larger in increments of four cylinders, hence X-8, X-12, X-16, X-20, etc. The non-90° X-engine can be significantly narrower than a comparable 90° X-engine in one dimension.

It is also understood that configurations which can satisfy an even-firing 2-stroke process could also be used for an odd-firing 4-stroke process, or conversely, configurations which can satisfy an even-firing 4-stroke process could also be used for double-firing 2-stroke process.

In view of the foregoing, an X-Engine assembly with perfect balance comprises four cylinder banks arranged around a central crankshaft, the cylinder banks lying in two intersecting planes with a crankshaft axis being on a line which is the intersection of the two planes. The same number of cylinders are on each cylinder bank. The crankshaft has one or more crankpins, with each crankpin having one or more reciprocating assemblies coupled to it. The reciprocating assemblies are offset relative to each other along the crankshaft axis. Each reciprocating assembly is coupled to a crankpin on the crankshaft in such a way that, as the crankshaft rotates, the reciprocating assembly moves in reciprocating-linear motion. An outward-facing piston is at both ends of each reciprocating assembly with each piston coaxially engaged with a cylinder of a cylinder bank. The two outward-facing pistons of each reciprocating assembly are coaxial with the axis of the pistons and being perpendicular to the crankshaft axis.

BRIEF DESCRIPTION OF THE DRAWINGS

While various embodiments of the invention are illustrated, the particular embodiments shown should not be construed to limit the claims. It is anticipated that various changes and modifications may be made without departing from the scope of this invention.

FIGS. 4(*a*) and 4(*b*) are a top view and side view, respectively, of the crankshaft (including counterweights) shown in FIGS. 1-3;

FIG. 4(*c*) is an exploded view of the X-4 crank train including the crankshaft, two DASY assemblies, and two bearing block assemblies;

FIG. 4(*d*) is an isometric view of the X-4 crank train when assembled;

FIG. 5(*b*) is a top-hidden-line view of the crankshaft (without counterweights) shown in FIG. 5(*a*);

FIG. 5(*c*) is an isometric view of the X-8 crank train for even-firing 4-stroke cycle with X-Y-Z coordinates used in the balance calculation analysis;

FIG. 5(*d*) is an isometric view of the X-8 engine bottom end assembly showing the four cylinder banks of an X-engine;

FIG. 7(*b*) is a top-hidden-line view of the crankshaft (without counterweights) shown in FIG. 7(*a*);

FIG. 7(*c*) is an isometric view of the X-12 crank train for even-firing 2-stroke cycle with X-Y-Z coordinates used in the balance calculation analysis;

FIG. 9(*b*) is an isometric view of the X-16 crank train for even-firing 4-stroke cycle with X-Y-Z coordinates used in the balance calculation analysis;

FIG. 9(*c*) is a top-hidden-line view of the crankshaft (without counterweights) shown in FIG. 9(*a*);

FIG. 11(*b*) is an isometric view of the X-4 (2-stroke) crank train with X-Y-Z coordinates used in the balance calculation analysis;

FIG. 13(*b*) is an isometric view of the X-12 crank train for even-firing 4-stroke cycle with X-Y-Z coordinates used in the balance calculation analysis;

FIG. 13(*c*) is a top-hidden-line view of the crankshaft (without counterweights) shown in FIG. 13(*a*);

FIG. 15(*b*) is an isometric view of the X-8 crank train for even-firing 2-stroke cycle with X-Y-Z coordinates used in the balance calculation analysis;

FIG. 15(*c*) is a top-hidden-line view of the crankshaft (without counterweights) shown in FIG. 15(*a*);

FIG. 17(*b*) is a top-hidden-line view of the crankshaft (without counterweights) shown in 17(*a*);

FIG. 17(*c*) is a top-view of the X-8 crank train for even-firing 4-stroke cycle with a 75° X-angle;

FIG. 17(*d*) is a top-view of the 75° X-8 engine bottom end assembly;

FIG. 18(*b*) is an isometric view of the 75° X-8 engine bottom end assembly;

FIG. 18(*c*) is an isometric view of a crankshaft for the X-12 engine with a 75° X-angle for even-firing 4-stroke cycle;

FIG. 18(*d*) is a top-hidden-line view of the crankshaft (without counterweights) shown in FIG. 18(*c*);

DETAILED DESCRIPTION OF THE INVENTION

Below are illustrations and explanations for a Double-Acting Scotch Yoke (DASY) assembly for an X-engine configuration, and for DASY X-engine configurations which are perfectly balanced and even-firing for 2-stroke, 4-stroke and other engine cycles and have potential to satisfy the needs for practical engine applications. However, it is noted that these assemblies and configurations may be configured to suit any specific application and is not limited only to the example in the illustrations.

Figure 1:
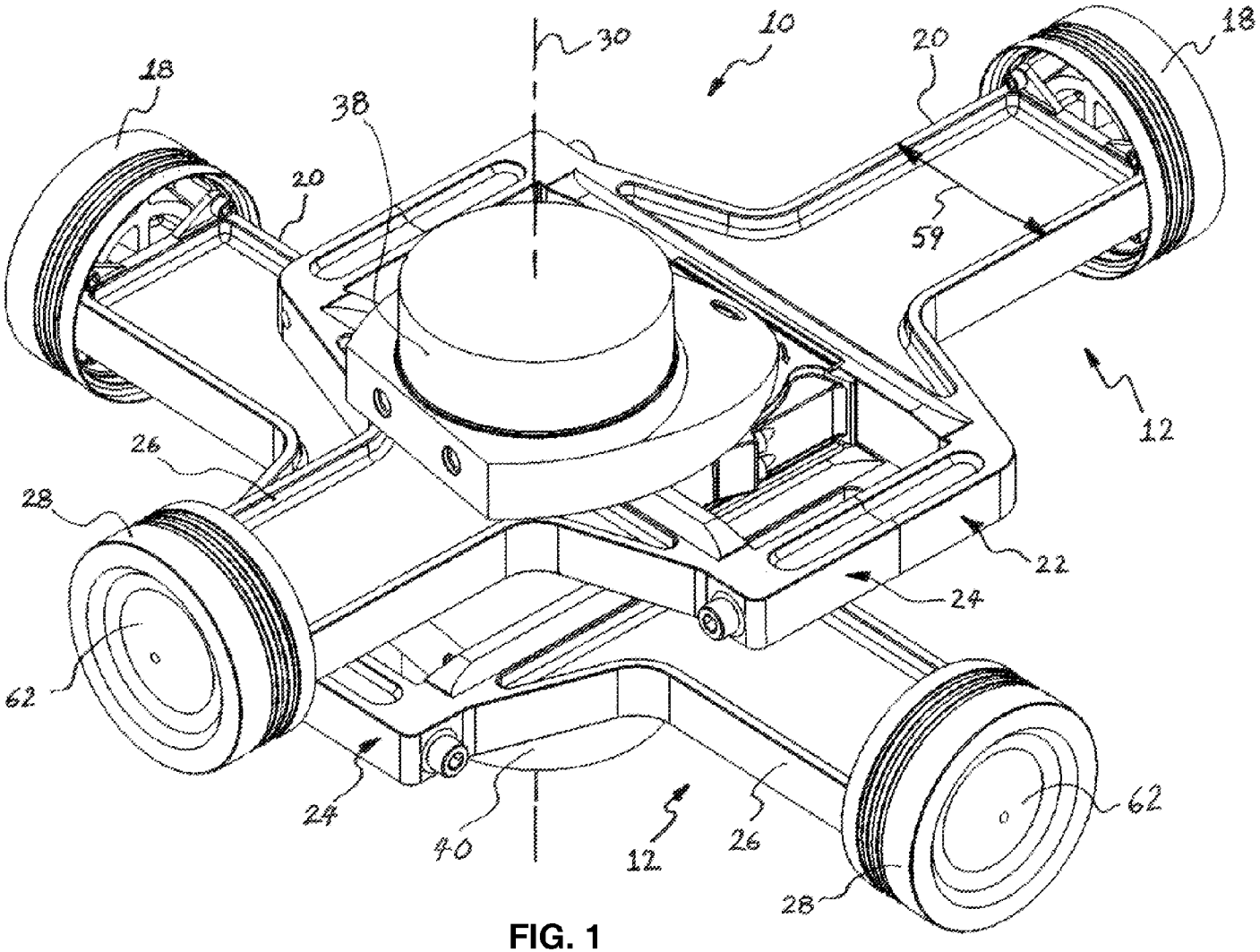
FIG. 1 is an isometric view of the DASY X-4 engine crank train which includes one crankshaft and four pistons (for FIGS. 1, 2, 3 (*a*)-(*b*)) the crankshaft does not include counterweights to allow viewing of the parts)
Figure 2:
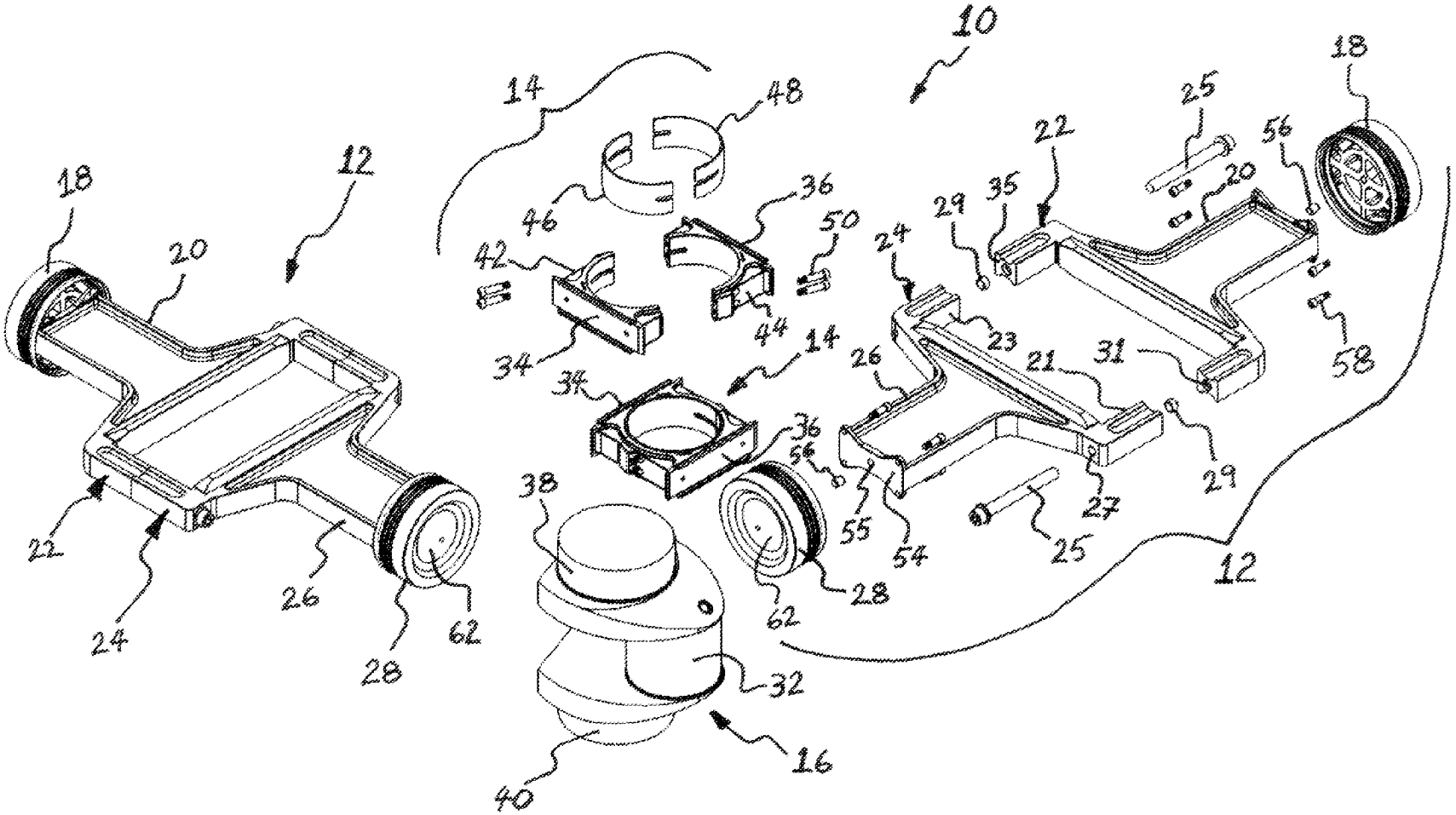
FIG. 2 is an exploded view of the DASY X-4 engine crank train of FIG. 1 including two DASY assemblies (one in exploded view), two bearing block assemblies (one in exploded view) and a crankshaft according to an embodiment of the invention.

Referring now to FIGS. 1-2, a Double-Acting Scotch Yoke (DASY) X-Engine crank train 10 is shown according to an embodiment of the invention. In general, the crank train 10 includes two DASY assemblies 12, two bearing block assemblies 14 and a crankshaft 16. In the illustrated embodiment, the X-engine crank train 10 is configured as a DASY X-4 crank train. However, it will be appreciated that the DASY X-4 crank train 10 can be grouped together in multiples to form other X-engine systems, such as a X-8 engine crank train, a X-12 engine crank train, a X-16 engine crank train, and the like.

The DASY assembly 12 forms a basic building block of the DASY X-engine crank train 10 and comprises four components joined together in series:

1) a first piston 18;

2) a first yoke 22 rigidly attached to the first piston 18;

3) a second yoke 24 rigidly attached to the first yoke 22; and 4) a second piston 28 rigidly attached to the second yoke 26.

It should be noted that the first piston 18 is identical to the second piston 28, and the first yoke 22 is identical to the second yoke 24.

The yokes 22, 24 are rigidly connected to each other by using a pair of threaded fasteners 25, such as bolts, and the like, that are passed through a non-threaded hole 27 in one leg 21 of the yoke 22, 24 and received in a threaded hole 31 in the leg 23 of the other yoke 22, 24, as shown in FIG. 4. A dowel 29 is positioned within a separate countersunk bore (not shown) that can be on-axis with holes 27, 31 or can be offset from the axis of the holes 27, 31. It will be appreciated that the invention is not limited by the use of the dowel 29 for positioning the two yokes 22, 24 with respect to each other, and that the invention can be practiced by using any suitable structure known in the art for precisely positioning the two yokes 22, 24 with respect to each other. Each leg 21, 23 of each yoke 22, 24 has a planar end surface 35 that forms a flat-to-flat interface between the two yokes 22, 24 when assembled. That is, each yoke 22, 24 has two planar end surfaces 35 that form a flat-to-flat interface between the two yokes 22, 24.

It is also noted that the yokes 22, 24 are identical to each other so that the same part can be used on both sides of the bearing block assembly 14 by rotating one of the yokes 180° with respect to the other yoke, which results in a reduction of different parts necessary in the assembly 12.

Figure 3A:
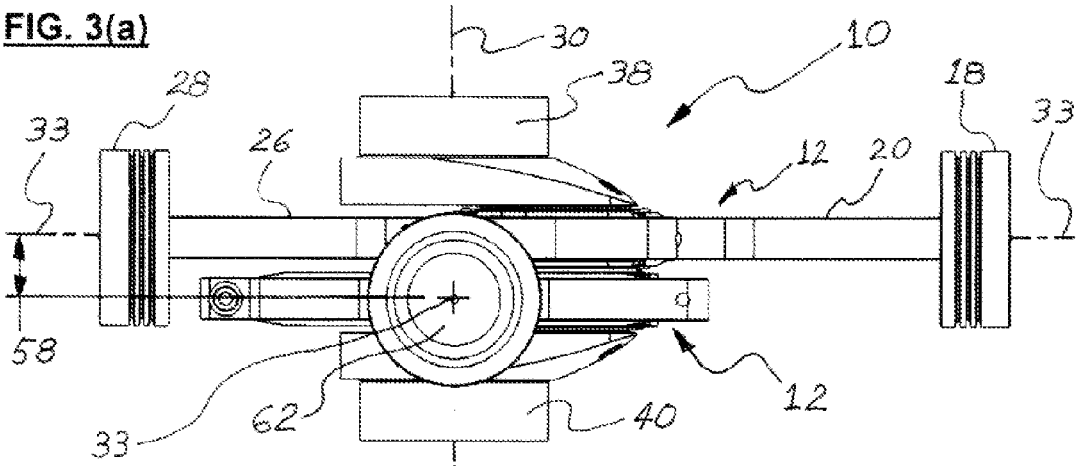
FIGS. 3(*a*) and 3(*b*) are side and top views, respectively, of the DASY X-4 engine crank train of FIG. 1.
Figure 3B:
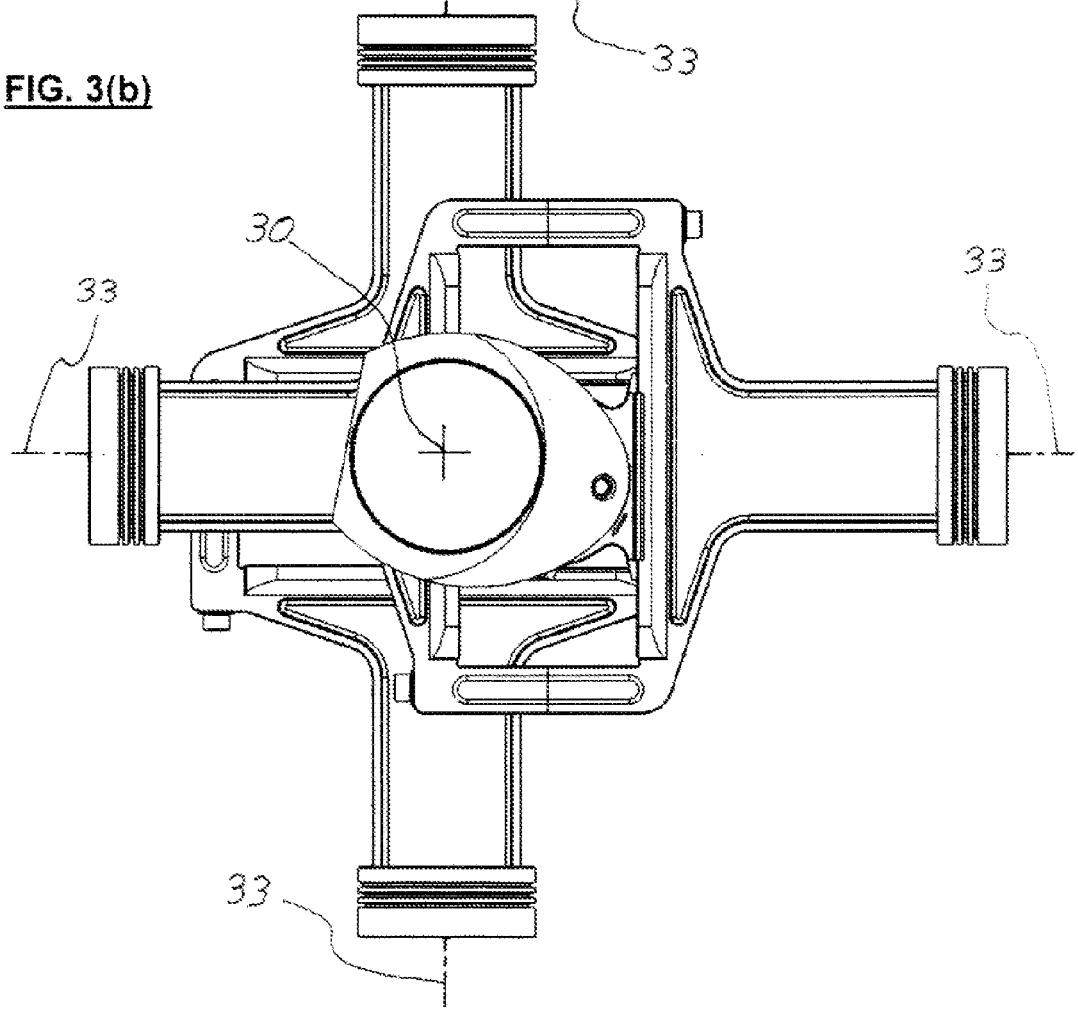
Figure 5A:
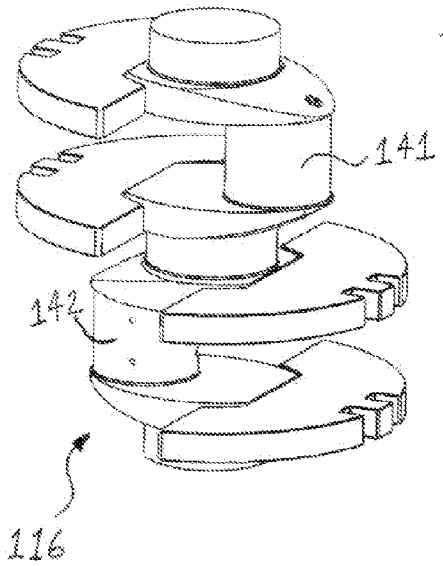
FIG. 5(*a*) is an isometric view of a crankshaft for the X-8 engine shown in FIG. 5(*a*)
Figure 5B:
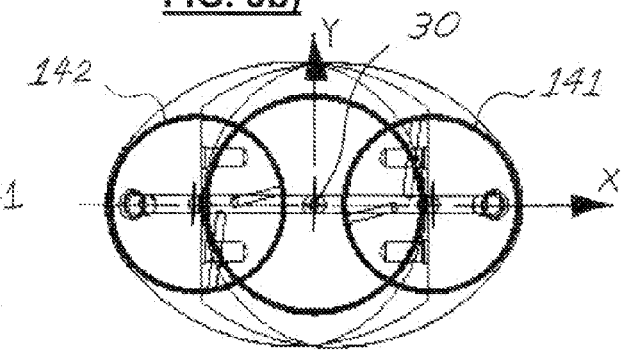
Figure 5C:
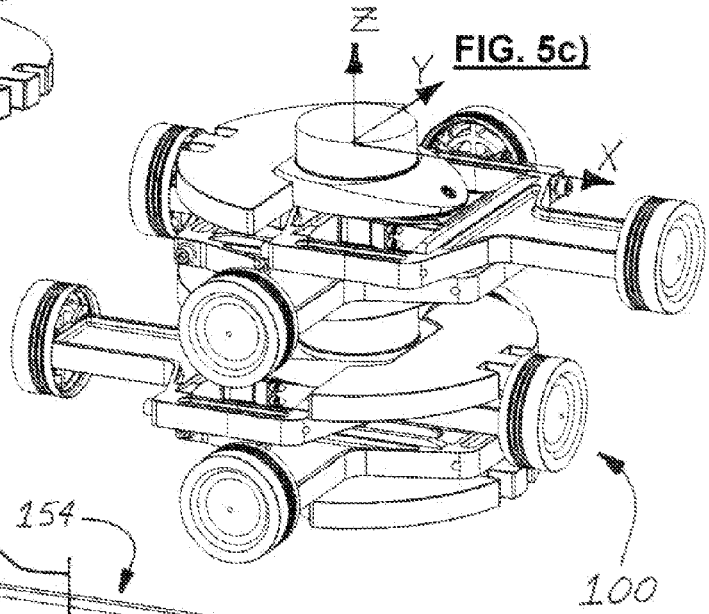
Figure 5D:
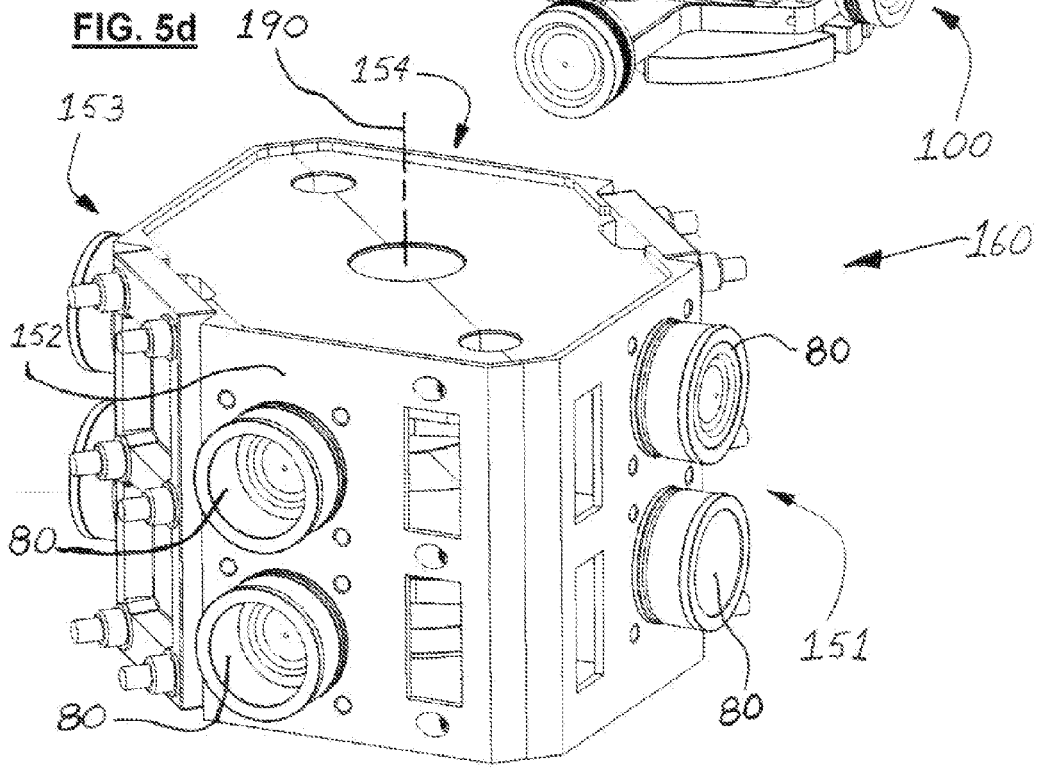
Figure 6A:
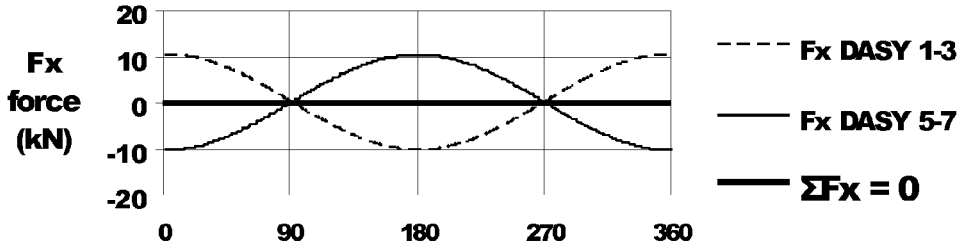
FIG. 6(*a-e*) are graphical representations of the balance calculation results for the X-8 configuration for 4-stroke cycle. In order: forces in the x-direction, forces in the y-direction, moments about the y-axis, moments about the x-axis, moments about the z-axis which are the torsional loads on the crankshaft due to reciprocating masses. (NOTE: all figures which have balance calculation results are configured the same as FIGS. 6(*a-e*))
Figure 6B:
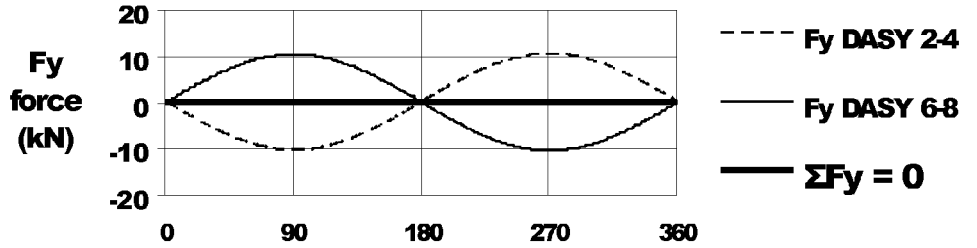
Figure 6C:
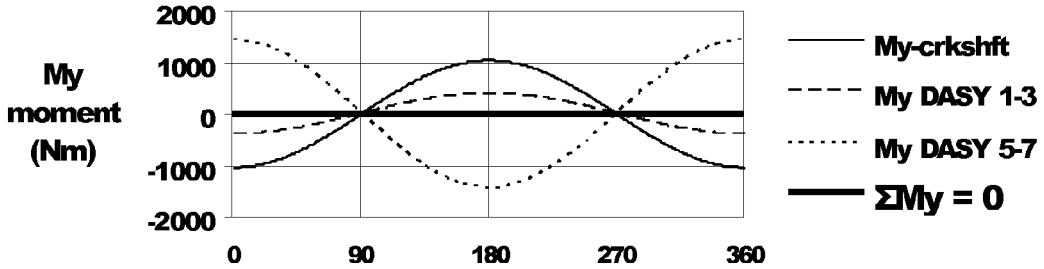
Figure 6D:
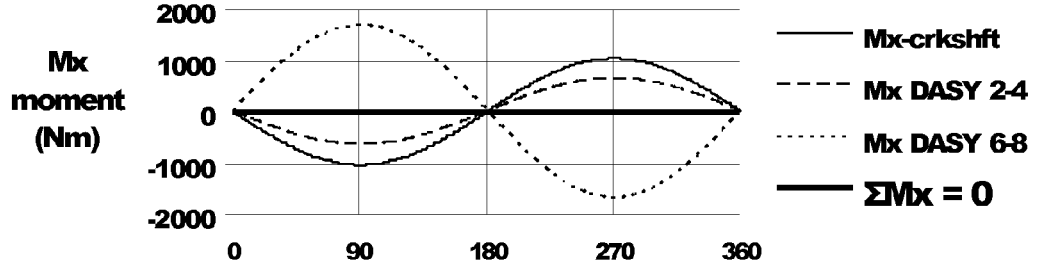
Figure 6E:
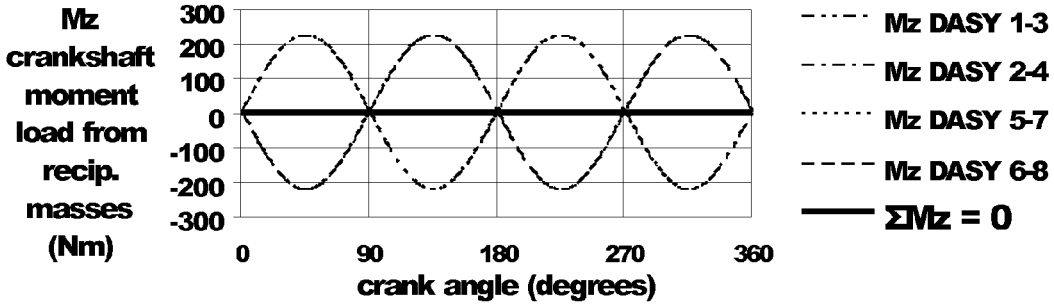

One aspect of the invention is that the yokes 22 24, the dowels 29, the threaded fasteners 25 and the pistons 18, 28 of the DASY assembly 12 in a purely symmetrical relation to a common, center axis 33 of the two opposing pistons 18, 28, and the common, center axis 33 of the two opposing pistons 18, 28 is perpendicular to a center axis 30 of the crankshaft 16 in the assembled X-engine configuration, as shown in FIG. 3. This feature enables the center-of-mass of the DASY assembly 12 to be located on the common, center axis 33 of the two opposing pistons 18, 28, which is desirable in order to achieve balance of reciprocating and rotating masses during operation of the X-engine.

The piston rings function in the same way as rings for conventional con rod piston-engines. Each piston 18, 28 includes a combustion face 62 on its end, which is formed to suit the requirements of the combustion process being used.

Referring back to FIGS. 1-2, each bearing block assembly 14 includes two identical bearing block halves 42, 44 and capture a pair of 180° bearing shells 46, 48 that surround the crankpin 32 in a slideable, rotatable manner. A plurality of threaded fasteners 50, such as bolts, and the like, hold the bearing block assembly 14 together. The two bearing block assemblies 14 are assembled around the crankpin 32 of the crankshaft 16. Each bearing block assembly 14 is coupled to its respective DASY assembly 12 by two linear bearing surfaces 34, 36 located at opposing ends of the bearing block assembly 14.

As shown in FIGS. 1, 2 and 3(*a, b*), the crankshaft 16 has its main bearings 38, 40 positioned on the center axis 30 of the crankshaft 16 so that as the crankshaft 16 rotates, the crankpin 32 is rotating around the center axis 30 of the crankshaft 16 in an eccentric fashion.

In the illustrated example of the DASY X-4 engine crank train 10 shown in FIGS. 1, 2 and 3(*a, b*), there are two bearing block assemblies 14 disposed about the crankpin 32 of the crankshaft 16 with each bearing block assembly 14 axially separated from one another and occupying a space along the outer surface of the crankpin 32 and each facing in a different orientation. Specifically, the two bearing block assemblies 14 are oriented 90° with respect to each other. Referring now to FIG. 3(*a*), is a side-view of the DASY X-4 crank train 10 with the axis 33 of one DASY assembly 12 shown with an offset 58 relative to the axis 33 of the other DASY assembly. This offset 58 is along the axis 30 of the crankshaft 16. In FIG. 3(*b*) the X-4 crank train is shown in top view to reveal a right-angle relation of the two DASY center axes 33 which both intersect the axis of the crankshaft 30.

It is noted that the interface between the DASY assembly 12 and the bearing block assembly 14 are two flat-to-flat sliding interfaces (i.e., linear bearing surface 34 contacts yoke 24, and linear bearing surface 36 contacts yoke 22) that are perpendicular to the common, center axis 33 of the two opposing pistons 18, 28. The two bearing block assemblies 14 surround and engage the crankpin 32 of the crankshaft 16 and revolve, but do not rotate, around the center axis 30 of the crankshaft 16 as the crankshaft 16 rotates. Each DASY assembly 12 is coupled to the bearing block assembly 14 in such a way that rotating motion of the crankshaft 16 is translated to a reciprocating (pure sinusoidal) motion of the DASY assemblies 12.

For the X-4 crank train 10, the two DASY reciprocating assemblies 12 are mounted transversely with respect to the crankshaft axis 30 which results in having the motion of the two DASY assemblies 12 being 90° out of phase with respect to each other, so for the X-4 crank train 10 one piston crosses through top-center position for every 90° of crankshaft 16 rotation.

The motion of the DASY assembly 12 is reciprocating harmonic (sinusoidal) motion. The result is:

- a power-conversion system which allows two coaxially-opposed cylinders of an engine to be coupled to a central crankshaft through a single crankpin bearing;
- pure sinusoidal motion such that X-engine configurations which achieve $1^{st}$-order balance, thus have 100% balance for all orders of vibration;
- the firing order relationship for each scotch yoke piston pair of the DASY assembly 12 in a 4-stroke cycle engine is 180°/540°; and
- the firing order relationship for each scotch yoke piston pair in a 2-stroke cycle engine is 180°/180°.

The kinematic equations for the scotch yoke mechanism are:

$$\text{piston displacement: } x=r(\sin(\omega t)) \quad (1)$$

$$\text{piston velocity: } v=\omega r(\cos(\omega t)) \quad (2)$$

$$\text{piston acceleration: } a=-\omega^2 r(\sin(\omega t)) \quad (3)$$

To achieve force balance for an X-4 group in a DASY X-engine, the following formula describes the relation for balancing each crankshaft section which is coupled to a two bearing blocks and two DASY reciprocating assemblies, given the masses of the bearing block assembly and the DASY assembly:

$$m_{crank\text{-}X\text{-}4\ section} * x\text{-bar} = (2m_{bearing\text{-}block} + m_{DASY})(\text{stroke}/2) \quad (4)$$

where:

r=crank radius=stroke/2

$\omega=2\pi n$ n=(engine speed)

$m_{DASY}$=mass of DASY assembly $m_{bearing\text{-}block}$=mass of bearing block $m_{crank\text{-}X\text{-}4\ section}$=mass of crankshaft section for X-4 group x-bar=center of mass of $m_{crank\text{-}X\text{-}4\ section}$ relative to crankshaft axis Referring now to FIGS. 4(*a*)-(*d*), the crankshaft assembly 416 has counterweights 71 attached to the X-4 crankshaft section 16. The crankshaft assembly 416 is designed so that it's mass (consisting of the crankshaft 16, counterweights 71 and including fasteners, etc.), and the distance to the center of mass 72, represented by "x-bar" in the equation, are such that the above equation is satisfied which results in having the rotating forces of the crankshaft perfectly cancel out the forces from the two reciprocating DASY assemblies 12 and the two bearing block assemblies 14. It should be noted that the center of mass 72 is on plane with the crankshaft centerline 30 and the crankpin centerline 37, and is on a plane which is perpendicular to the crankshaft centerline 30 and equidistant from the two DASY centerlines 33 and (as shown in FIG. 3(*a*)). It should also be understood that the crankshaft assembly 416 shown has bolted-on counterweights, whereas it is also possible to have single piece crankshafts with integral counterweights.

The result is that the sum of the forces in both the x and y directions are continuously zero as the crankshaft rotates. However, in the case of the X-4 crank train there is still moment vibration loads which are unresolved. It will be seen that it is possible to achieve many useful engine configurations which are perfectly balanced and have even-firing for 4-stroke and 2-stroke engine cycles by using one of two methods: first, by having a plurality of X-4 groups to form engine crank trains with eight or more cylinders and using crankpin angular arrangements which result in zero forces and moments; second, by using the above defined method to resolve the rotating forces and also having a single $1^{st}$-order counter-rotating moment-balance shaft which is mounted in the engine structure on an axis parallel to the crankshaft. FIGS. 4(*c, d*) are exploded and assembly views of the balanced X-4 group 11, showing all the components which must have the specific mass relationship as defined in the above equation in order to achieve force balance. An analysis of the force balance for the balanced X-4 group 11 is shown graphically in FIGS. 12(*a, b*).

The following is a series of descriptions of DASY X-engine configurations including the balance calculation results shown graphically in figures. For all of these balance calculations, the following was used:

DASY mass=3.524 kg
bearing block mass=0.451 kg
stroke=86 mm
bore spacing=100 mm
X-engine bank offset=24 mm
engine speed=2500 RPM
crankshaft rotation=clockwise (looking down z-axis)
X-angle=90° (unless otherwise noted)

For all of the balance calculations, it is assumed that the crankshaft rotates with constant angular velocity, and the direction of rotation for the crankshaft is clockwise looking down the z-axis. The first four cylinders #1-#4 are the top X-4 group of the engine and correspond to banks 151-154, respectively, as shown in FIG. 5(*d*). The X-Y-Z coordinate system used for each analysis is placed on the crankshaft axis 30 at the center of the uppermost main bearing such that all of the cylinder axes are below the X-Y plane. DASYs with odd numbered cylinders are always parallel to the x-axis. For example, "DASY 1-3" in the graphs indicates the DASY that engages cylinders #1 and #3, which are on banks 151, 153 in FIG. 5(*d*). With regards to the graphical representations of the balance calculation results, the horizontal axis for all graphs is crank angle degrees from 0° to 360° which covers a full revolution of the crankshaft. For all cases, the piston for cylinder #1 is at top-center at 0° with respect to the balance calculation. Also regarding the balance calculation graphs, the terms "Fx crkshft" and "Fy crkshft" represent the combined rotating forces of the crankshaft and all of the bearing blocks connected to it resolved to the x and y directions, and the terms "Mx crankshaft" (or "Mx crkshaft") and "My crankshaft" (or "My crkshaft") represent the combined rotating moments again including the crankshaft and all the bearing blocks connected to it resolved to the two axes x and y.

It is understood to one skilled in engine engineering art that an engine that is balanced at one speed is thusly balanced at all speeds regardless of crankshaft rotation direction, and also that these analyses, even though they are for specific engine dimensions, reciprocating masses, etc., demonstrate these engine configurations for all applications with different values than those listed above. Also, it should be understood that the crankshaft as defined here uses the same counterweight configuration adjacent to each crankpin, whereas it is possible to configure the crankshaft counterweights in an infinite number of ways and still achieve the necessary balancing effect for rotating forces and moments. Lastly, regarding configurations described herein that involve a balance shaft, the balance shaft is realized to have counter-rotating synchronized motion relative to the crankshaft, rotates at crankshaft speed, and generates a rotating moment.

The DASY X-8 configuration for even-firing 4-stroke cycle is shown in FIGS. 5(*a*)-(*d*). In FIG. 5(*a*) is the crankshaft 116 which has two crankpins 141, 142, and FIG. 5(*b*) is a top-hidden-line view of the crankshaft (without the counterweights) showing that the two crankpins 141, 142 are arranged 180° opposed relative to the crankshaft centerline 30, and FIG. 5(*c*) has a view of the X-8 (4-stroke) crank train 100 showing the X-Y-Z coordinate system used in the balance calculation. In FIG. 5(*d*) is a view of the engine bottom end assembly 160 which has four banks of cylinders 151, 152, 153, 154, which are arranged in "X" configuration around the main axis of the engine 190, with two cylinders 80 on each bank of cylinders 151, 152, 153, 154. The crankshaft axis 30 is on line with the engine main axis 190 in the engine bottom end assembly 160.

Having the two crankpins 141, 142 on opposite sides of the crankshaft axis 30 results in the crankshaft being balanced for forces, but generating a rotating couple as the crankshaft rotates. This rotating couple, it will be seen, acts to cancel out the resultant vibration moments generated by the reciprocating DASY assemblies 12. Secondly, having the two crankpins 141, 142 arranged in this way results in having two pistons 18, 28 coming to top-center for every 90° of rotation of the crankshaft—a condition which is necessary for achieving an even-firing 4-stroke eight-cylinder engine.

The upper crankpin 141 has two reciprocating assemblies coupled to it to engage a cylinder on each of the four banks 151, 152, 153, 154, which are numbered cylinders #1, #2, #3, #4 corresponding to the cylinder banks 151, 152, 153, 154, respectively, and the second (lower) crankpin 142 is associated with the lower four cylinders numbered #5, #6, #7, #8 associated with the four cylinder banks in the same way. Hence, the DASY assembly 12 that engages opposing cylinders 1 and 3 is referred to "DASY 1-3" in the analysis results. Thus, DASYs with odd cylinder numbers are moving parallel to the x-axis, and DASYs with even cylinder numbers are moving parallel to the y-axis.

In FIGS. 6(*a*)-(*e*), the balance calculation analytical results for the X-8 engine crank train for even-firing 4-stroke cycle are shown. In FIG. 6(*a*) it can be seen that the forces from the two DASY reciprocating assemblies which move in the x-axis direction are canceling each other out which results in $\Sigma Fx=0$ on a continuous basis, and the same result occurs for y-direction forces resulting in $\Sigma Fy=0$ continuously, as shown in FIG. 6(*b*). With regards to moments about the y-axis and the x-axis, in FIGS. 6(*c*) and (*d*), it can be seen that the crankshaft moment, which is a rotating moment that can be mathematically resolved to two moments which act on perpendicular axes x and y, acts to cancel out the moments generated by the DASYs so the result is $\Sigma My=0$ and $\Sigma Mx=0$ on a continuous basis. Lastly, in FIG. 6(*e*) the moment loading on the crankshaft as a result of the reciprocating DASY masses acting on the crankpin as it moves out of alignment with the centerline of the DASY 33 is shown. The result is $\Sigma Mz=0$ on a continuous basis which means that there is zero torsional acceleration on the crankshaft resulting from reciprocating masses.

Thus, the DASY X-8 (4-stroke) is perfectly balanced inherently (with no balancing mechanisms used) and is superior to practically any other even-firing eight cylinder engine configuration with regards to minimizing vibration. Furthermore, having zero torsional acceleration of the crankshaft from the reciprocating masses is also a superior result to practically any eight cylinder engine configuration currently used.

While the DASY X-8 (4-stroke) engine can be made to fire evenly using any of four different crankshaft configurations –0°-0°, 0°-90°, 0°-180°, 0°-270°—only the 0°-180° crankshaft configuration as shown in FIGS. 5(*a, b*) provides perfect balance inherently, while the other three configurations –0°-0°, 0°-90°, 0°-270°—would each require a balance shaft to achieve perfect balance. Using the 0°-180° crankshaft there are two X-4 groups which are running 180° out of phase to each other—a condition which causes the moment imbalances of each X-4 group to cancel each other out as can be seen in the analysis in FIGS. 6(*c, d*). There are eight possible firing orders for the even-fire 4-stroke X-8 with inherent perfect balance.

Figure 7A:
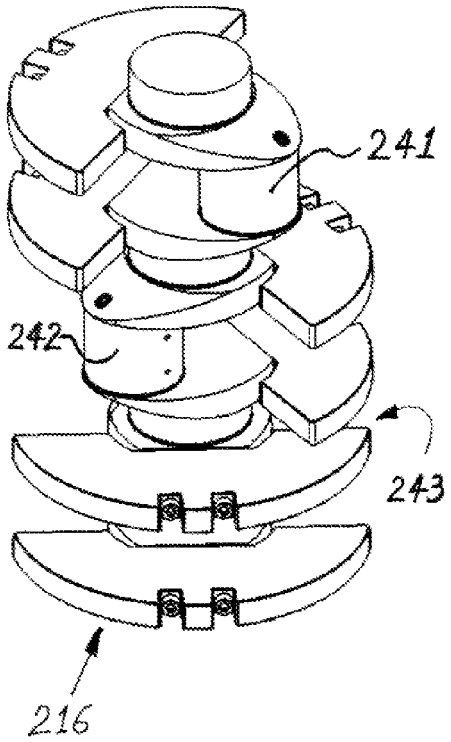
FIG. 7(*a*) is an isometric view of a crankshaft for the X-12 engine for even-firing 2-stroke cycle.
Figure 7B:
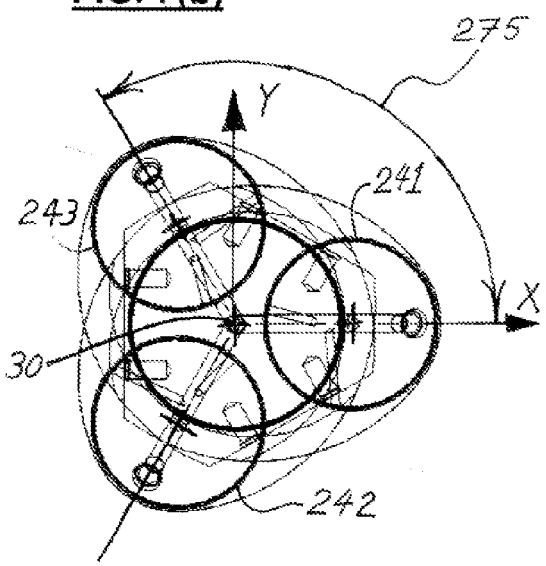
Figure 7C:
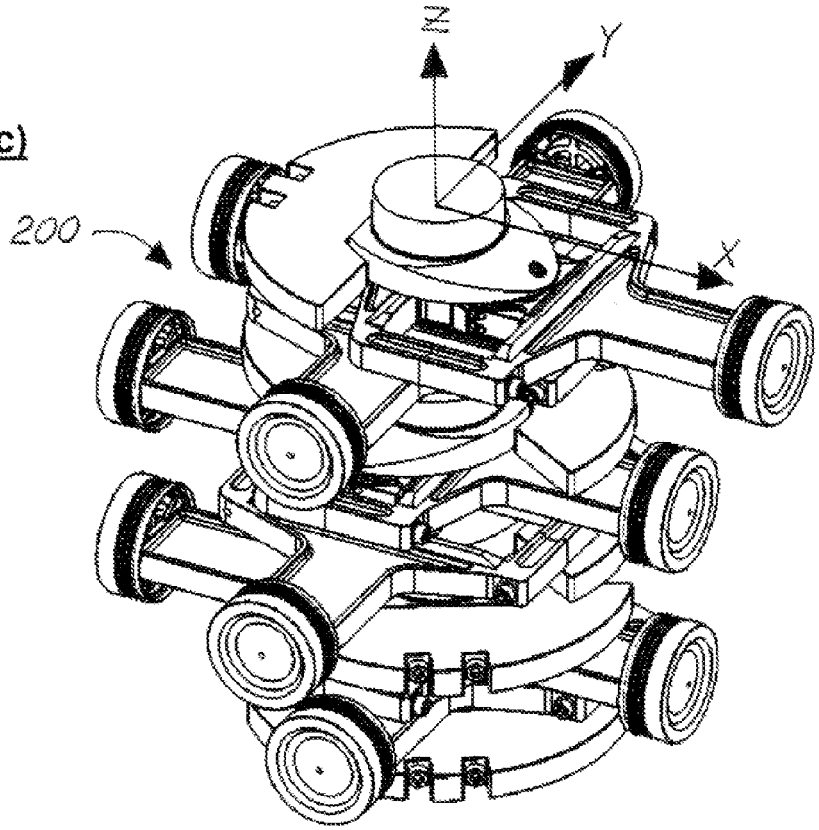
Figure 8A:
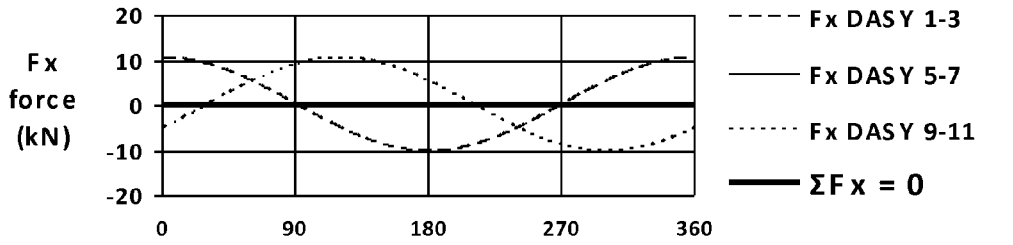
FIGS. 8(*a-e*) are graphical representations of the balance calculation results for the X-12 configuration for even-firing 2-stroke cycle.
Figure 8B:
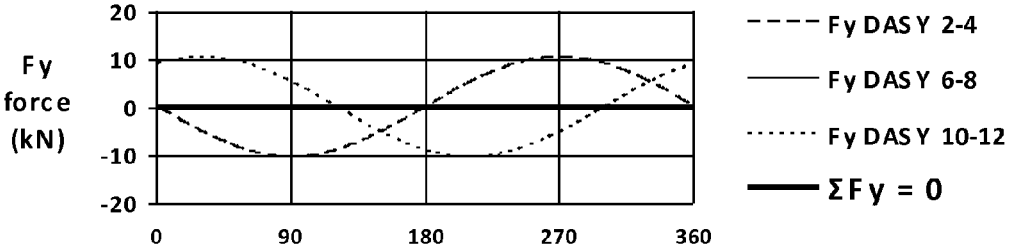
Figure 8C:
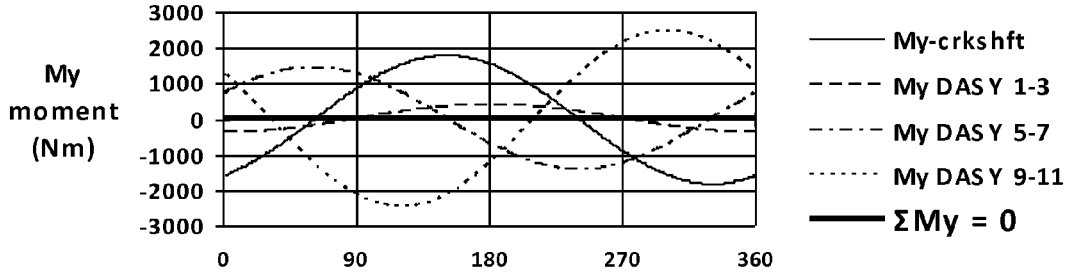
Figure 8D:
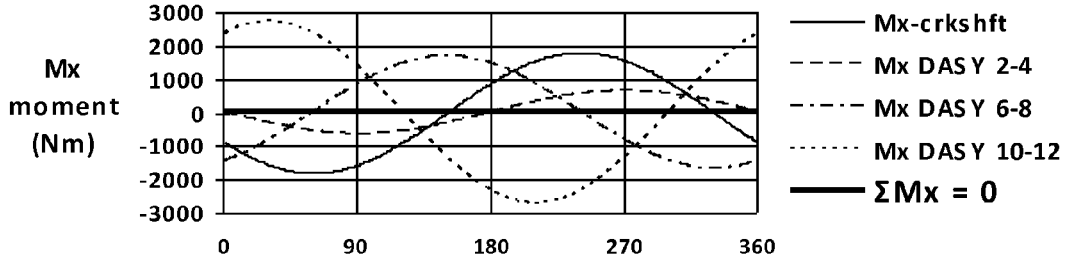
Figure 8E:
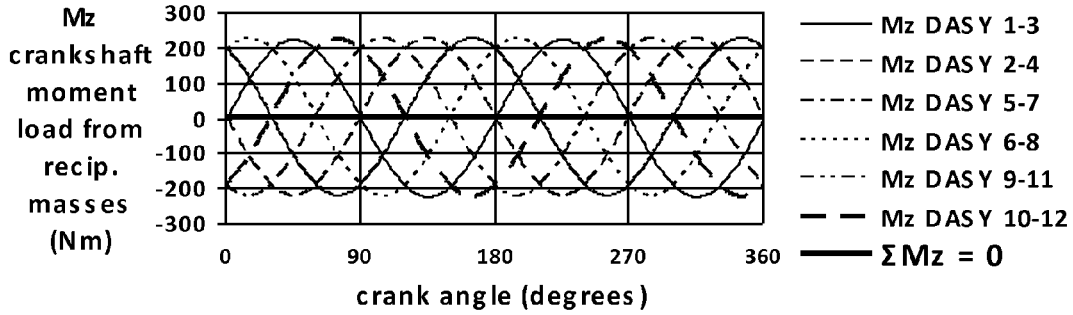

The DASY X-12 configuration for even-firing 2-stroke cycle is shown in FIGS. 7(*a-c*). In FIG. 7(*a*) is the crankshaft 216, which has three crankpins 241, 242, 243 which are arranged 120° relative to each other about the axis of the crankshaft 30, and in FIG. 7(*b*) is a top-hidden-line view of the crankshaft (without the counterweights) showing the angle 275 being 120° angle between pins 241 and 243, and FIG. 7(*c*) has a view of the X-12 (2-stroke) crank train 200 showing the X-Y-Z coordinate system used in the balance calculation. The engine bottom end assembly is similar to that shown in FIG. 5(*d*), except that there are three cylinders 80 on each of four banks of cylinders 151, 152, 153, 154.

Having the three crankpins 241, 242, 243 arranged with a 120° mutual angular spacing results in having the crankshaft 216 being balanced for forces, but generating a rotating couple as the crankshaft rotates. This rotating couple, it will be seen, acts to cancel out the resultant vibration moments generated by the reciprocating DASY assemblies 12. Secondly, having the three crankpins 241, 242, 243 arranged in this way results in having one piston 18, 28 coming to top-center for every 30° of rotation of the crankshaft—a condition which is necessary for achieving an even-firing 2-stroke 12-cylinder engine.

The upper crankpin 241 has two reciprocating assemblies coupled to it to engage a cylinder on each of the four banks, which are numbered cylinders #1, #2, #3, #4 corresponding to the cylinder banks 151, 152, 153, 154, respectively, and the two lower crankpins 242, 243 are associated with the second and third groups of four cylinders numbered #5, #6, #7, #8, and #9, #10, #11, #12, respectively.

In FIGS. 8(*a*)-(*e*) the balance calculation analytical results for the X-12 engine crank train for even-firing 2-stroke cycle are shown. In FIG. 8(*a*), it can be seen that the forces from the three DASY reciprocating assemblies which move parallel to the x-axis direction, are canceling each other out, which results in $\Sigma Fx=0$ on a continuous basis, and the same result occurs for y-direction forces resulting in $\Sigma Fy=0$ continuously, as shown in FIG. 8(*b*). With regards to moments about the y-axis and the x-axis, in FIGS. 8(*c, d*) it can be seen that the crankshaft moment acts to cancel out the moments generated by the DASYs, so the result is $\Sigma My=0$ and $\Sigma Mx=0$ on a continuous basis. Lastly, in FIG. 8(*e*) the moment loading on the crankshaft as a result of the reciprocating masses acting on the crankpin as it moves out of alignment with the centerline of the DASY is shown. The result is $\Sigma Mz=0$ on a continuous basis.

Thus, the DASY X-12 (2-stroke) is perfectly balanced inherently (with no balancing mechanisms used) and has zero torsional loads on the crankshaft from reciprocating masses.

While the DASY X-12 (2-stroke) engine can be made to fire evenly using any of 32 different crankshaft configurations, there are only two configurations—0°-120°-240° and 0°-240°-120° (shown in FIGS. 7(*a*)-(*c*))—which provide perfect balance inherently (without the use of extra balancing mechanisms), while the other 30 configurations would each require a balance shaft to achieve perfect balance. Using either of the preferred crankshaft configurations, the forces from the reciprocating masses cancels out to zero, and the moment of the rotating crankshaft acts to cancel out moments generated by the reciprocating masses as can be seen in the graphs in FIGS. 8(*c*) and (*d*). There is one possible firing order for each preferred crankshaft. It is also possible to use this configuration for odd-fire 12-cylinder 4-stroke applications.

Figure 9A:
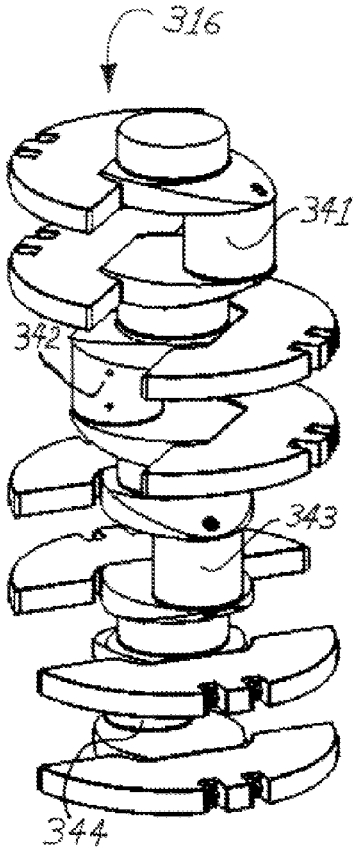
FIG. 9(*a*) is an isometric view of a crankshaft for the X-16 engine for even-firing 4-stroke cycle.
Figure 9B:
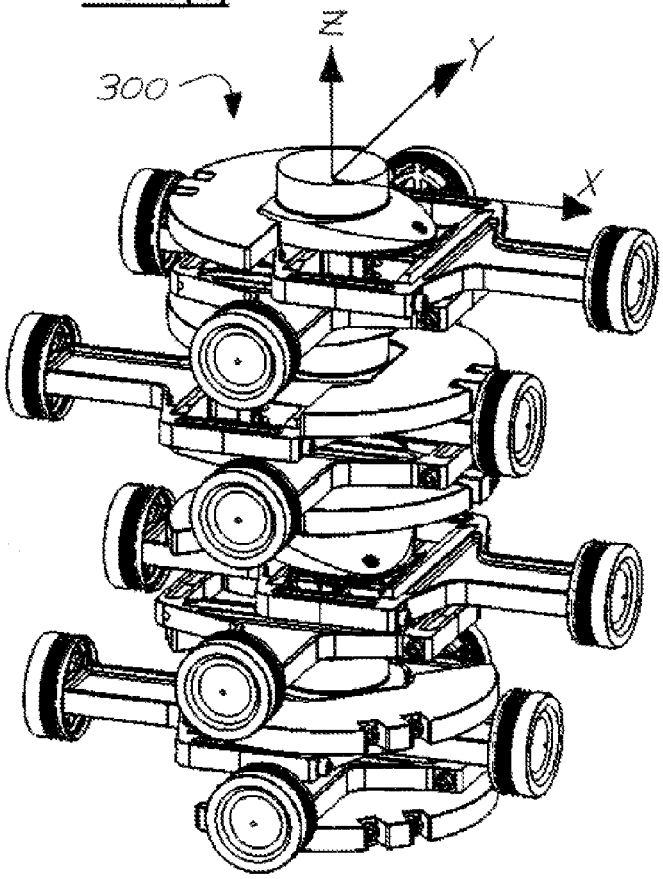
Figure 9C:
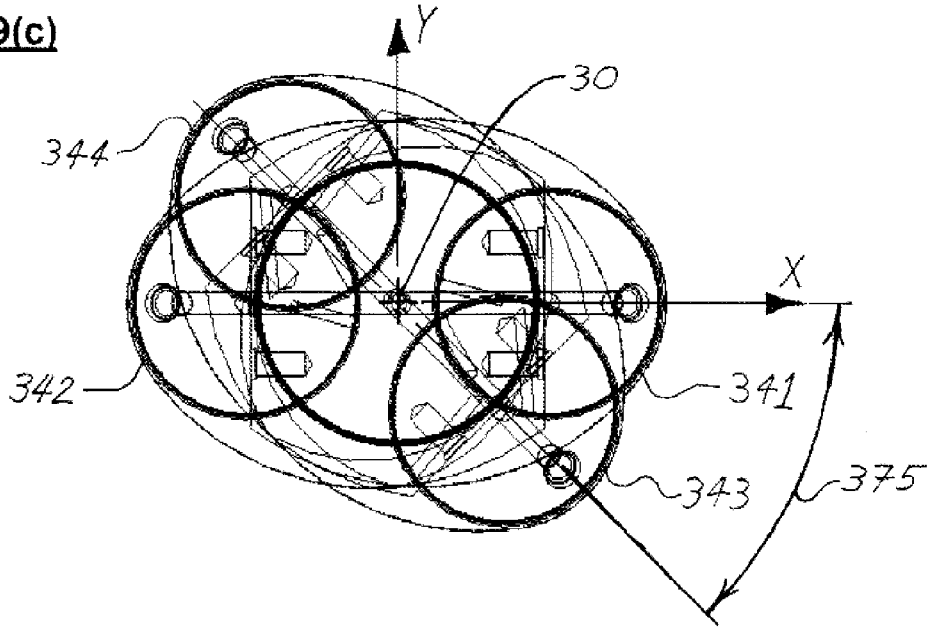
Figure 10A:
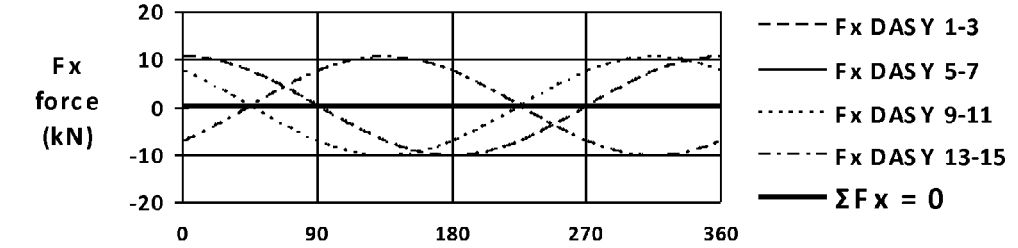
FIGS. 10(*a-e*) are graphical representations of the balance calculation results for the X-16 configuration for even-firing 4-stroke cycle.
Figure 10B:
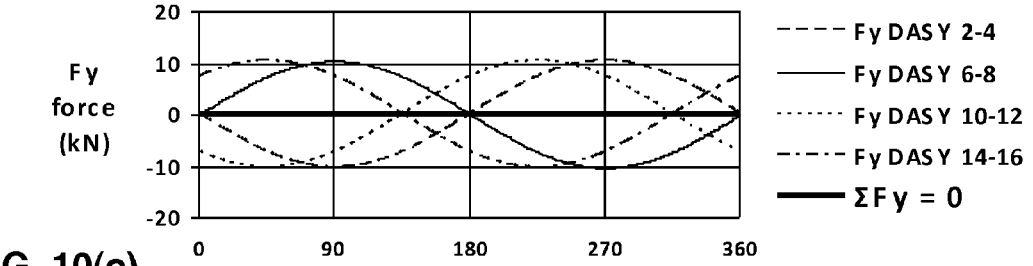
Figure 10C:
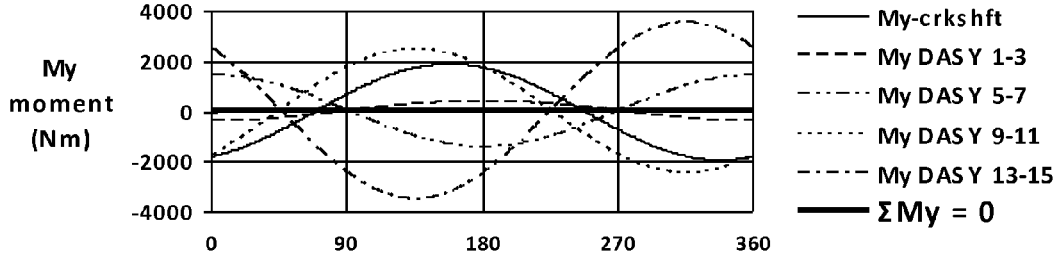
Figure 10D:
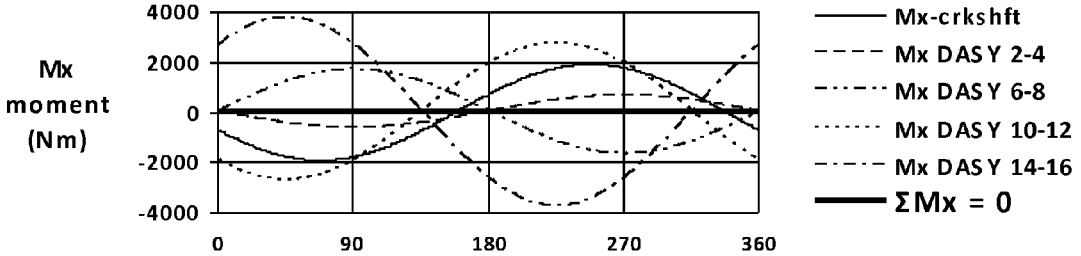
Figure 10E:
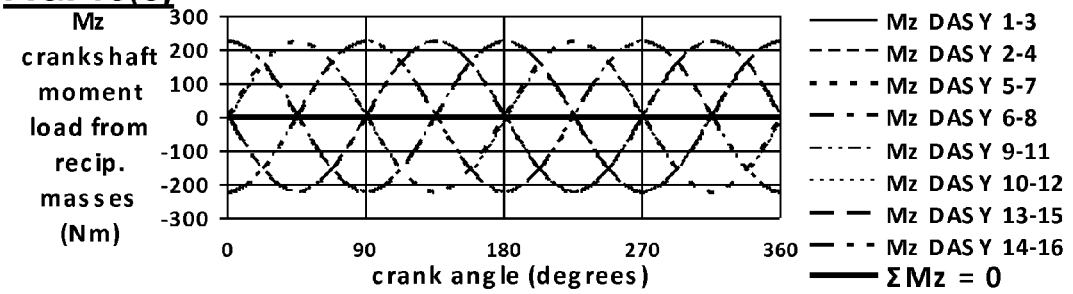

The DASY X-16 configuration for even-firing 4-stroke cycle is shown in FIGS. 9(*a*)-(*c*). FIG. 9(*a*) shows the crankshaft 316 that has four crankpins 341, 342, 343, 344, FIG. 9(*b*) is a view of the X-16 (4-stroke) crank train 300 showing the X-Y-Z coordinate system used in the balance calculation, and FIG. 9(*c*) is a top-hidden-line view of the crankshaft (without the counterweights) showing that the four crankpins 341, 342, 343, 344, are arranged in two pairs of 180°-opposed crankpins with the two opposed pairs of pins lying in planes which are 45° offset about the crankshaft axis 30, with crankpins 341 and 342 making one opposed pair, and crankpins 343 and 344 the other, and with angle 375 between the planes of the two pairs of opposed-crankpins being 45°. The engine bottom end assembly is similar to that shown in FIG. 5(*d*), except that there are four cylinders 80 on each of four banks of cylinders 151, 152, 153, 154.

Having the four crankpins 341, 342, 343, 344 arranged as two pairs of 180°-opposed crankpins about the crankshaft axis 30 results in the crankshaft 316 being balanced for forces, but generating a rotating couple as the crankshaft rotates. This rotating couple, it will be seen, acts to cancel out the resultant vibration moments generated by the reciprocating DASY assemblies 12. Secondly, having the four crankpins 341, 342, 343, 344 arranged in this way results in having two pistons 18, 28 coming to top-center for every 45° of rotation of the crankshaft—a condition which is necessary for achieving an even-firing 4-stroke 16-cylinder engine.

The upper crankpin 341 has two reciprocating DASY assemblies 12 coupled to it to engage a cylinder on each of the four banks, which are numbered cylinders #1, #2, #3, #4 corresponding to the cylinder banks 151, 152, 153, 154 respectively, and in the same way the three lower crankpins 342, 343, 344 are associated with the second, third and fourth groups of four cylinders numbered #5, #6, #7, #8, and #9, #10, #11, #12, and #13, #14, #15, #16, respectively.

In FIGS. 10(*a*)-(*e*), the balance calculation analytical results for the X-16 engine crank train for even-firing 4-stroke cycle are shown. In FIG. 10(*a*), it can be seen that the forces from the four DASY reciprocating assemblies, which move in the x-axis direction are canceling each other out, which results in $\Sigma Fx=0$ on a continuous basis, and the same result occurs for y-direction forces resulting in $\Sigma Fy=0$ continuously, as shown in FIG. 10(*b*). With regards to moments about the y-axis and the x-axis, in FIGS. 10(*c, d*) it can be seen that the crankshaft moment acts to cancel out the moments generated by the DASYs so the result is $\Sigma My=0$ and $\Sigma Mx=0$ on a continuous basis. Lastly, in FIG. 10(*e*), the moment loading on the crankshaft as a result of the reciprocating masses acting on the crankpin as it moves out of alignment with the centerline of the DASY is shown. The result is $\Sigma Mz=0$ on a continuous basis.

Thus, the DASY X-16 (4-stroke) is perfectly balanced inherently (with no balancing mechanisms used). While this embodiment defines one crankshaft configuration to achieve inherent perfect balance, there are 12 crankshaft configurations which can achieve inherent perfect balance and even-firing 4-stroke cycle, out of a total of 192 crankshaft configurations that have even-firing. There are 128 possible firing orders for each of the 12 crankshaft configurations for the even-fire 4-stroke X-16 with inherent perfect balance.

Figure 11A:
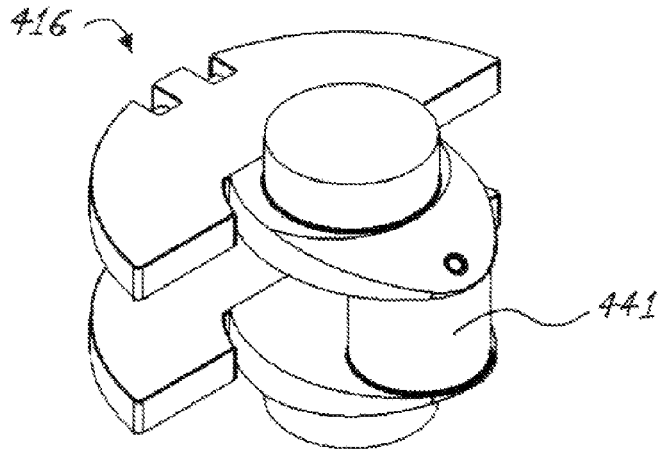
FIG. 11(*a*) is an isometric view of a crankshaft for the 2-stroke X-4.
Figure 11B:
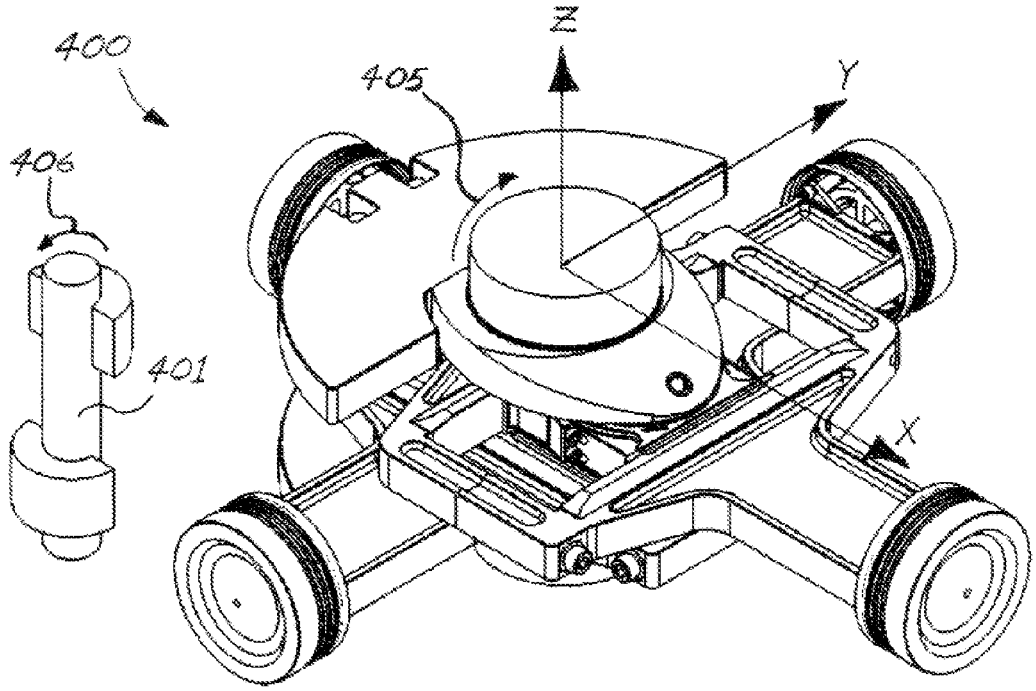
Figure 12A:
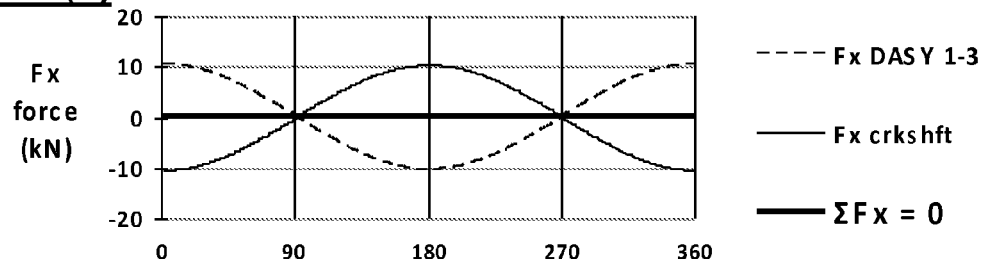
FIGS. 12(*a-e*) are graphical representations of the balance calculation results for the X-4 configuration for even-firing 2-stroke cycle.
Figure 12B:
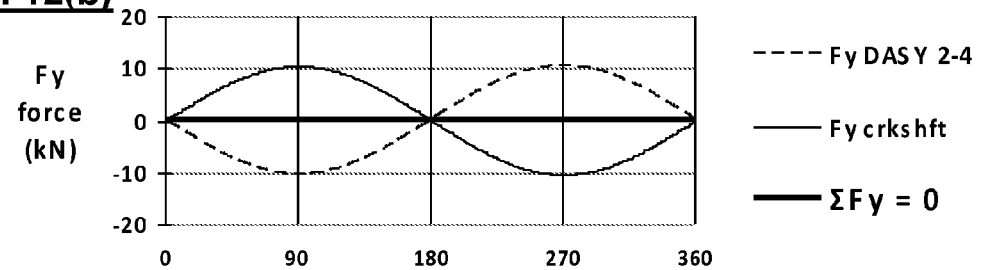
Figure 12C:
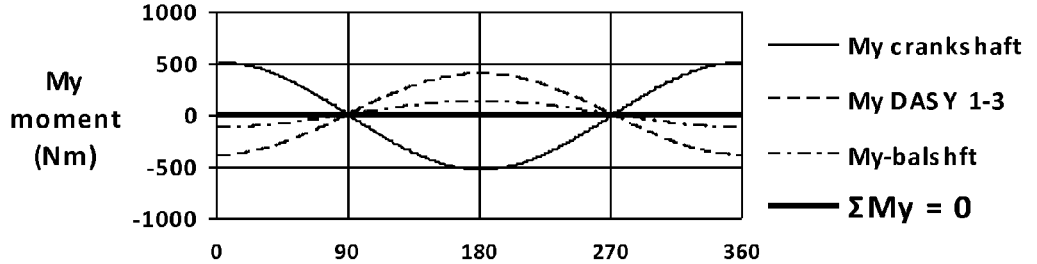
Figure 12D:
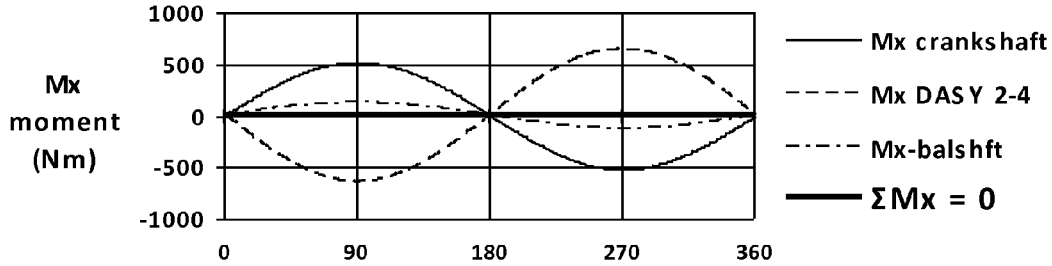
Figure 12E:
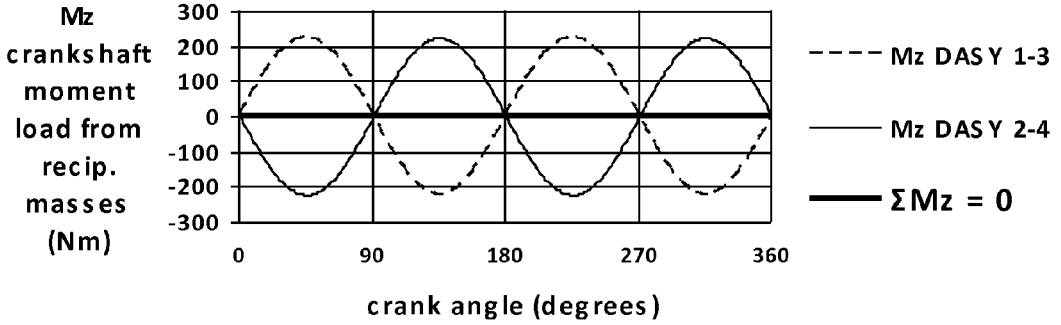

The DASY X-4 configuration for even-firing 2-stroke cycle is shown in FIGS. 11(*a*) and (*b*). In FIG. 11(*a*), the crankshaft 416 that has one crankpin 441 is shown, and FIG. 11(*b*) is a view of the X-4 (2-stroke) crank train 400 showing the X-Y-Z coordinate system used in the balance calculation. The engine bottom end assembly is similar to that shown in FIG. 5(*d*), except that there is one cylinder 80 on each of four banks of cylinders 151, 152, 153, 154. The crankpin 441 has two reciprocating assemblies coupled to it to engage a cylinder on each of the four banks, which are numbered cylinders #1, #2, #3, #4 corresponding to the cylinder banks 151, 152, 153, 154, respectively. Having one crankpin 441 results in the crankshaft 416 having a rotating force as the crankshaft rotates 405 which acts to perfectly counter the inertia forces of the two DASY reciprocating mechanisms 12. However, there is a residual vibration for the crankshaft 416, two bearing blocks 14 and the two DASYs 12 which is a rotating moment that rotates in the opposite direction to the crankshaft. Hence, as shown in FIG. 11(*b*), a single counter-rotating $1^{st}$-order moment-balance shaft 401 mounted in the engine structure on an axis parallel to the crankshaft axis 30, and rotates in the opposite direction 406 to the crankshaft rotation 405, is the solution for achieving perfect balance. It is also noteworthy that a single crankpin X-4 engine configured in this way results in having one piston 18, 28 coming to top-center for every 90° of rotation of the crankshaft—a condition which is necessary for achieving an even-firing 2-stroke 4-cylinder engine.

In FIGS. 12(*a*)-(*e*), the balance calculation analytical results for the X-4 engine crank train for even-firing 2-stroke cycle are shown. In FIG. 12(*a*), it can be seen that the forces from DASY 1-3 and the crankshaft in the x-axis direction are canceling each other out, which results in $\Sigma Fx=0$ on a continuous basis, and the same result occurs for y-direction forces for the crankshaft and DASY 2-4 resulting in $\Sigma Fy=0$ continuously, as shown in FIG. 12(*b*). With regards to moments about the y-axis and the x-axis, in FIGS. 12(*c*) and (*d*), it can be seen that the balance shaft moment acts to cancel out the moments generated by the crankshaft and DASYs, so the result is $\Sigma My=0$ and $\Sigma Mx=0$ on a continuous basis. Lastly, in FIG. 12(*e*), the moment loading on the crankshaft as a result of the reciprocating masses acting on the crankpin as it moves out of alignment with the centerline of the DASY is shown. The result is $\Sigma Mz=0$ on a continuous basis. This graph represents the simplest X-engine configuration and shows that the nature of the torsional loading on the crankshaft resulting from each reciprocating DASY 12 is a second-order sine wave, which for two DASYs running 90° out of phase results in perfect cancellation of the crankshaft moment loads. Other X-engine configurations, it should be noted, are multiple combinations of what is shown in FIG. 12(*e*).

Thus, the DASY X-4 (2-stroke) is perfectly balanced using a single $1^{st}$ order balance shaft 401. There is one crankshaft configuration with one firing order for the DASY X-4 (2-stroke) engine which is the sequence of when the cylinders reach top-center.

Figure 13A:
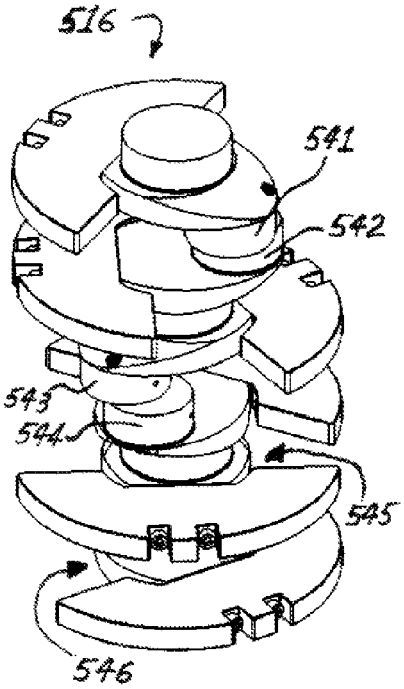
FIG. 13(*a*) is an isometric view of a crankshaft for the X-12 engine for even-firing 4-stroke cycle.
Figure 13B:
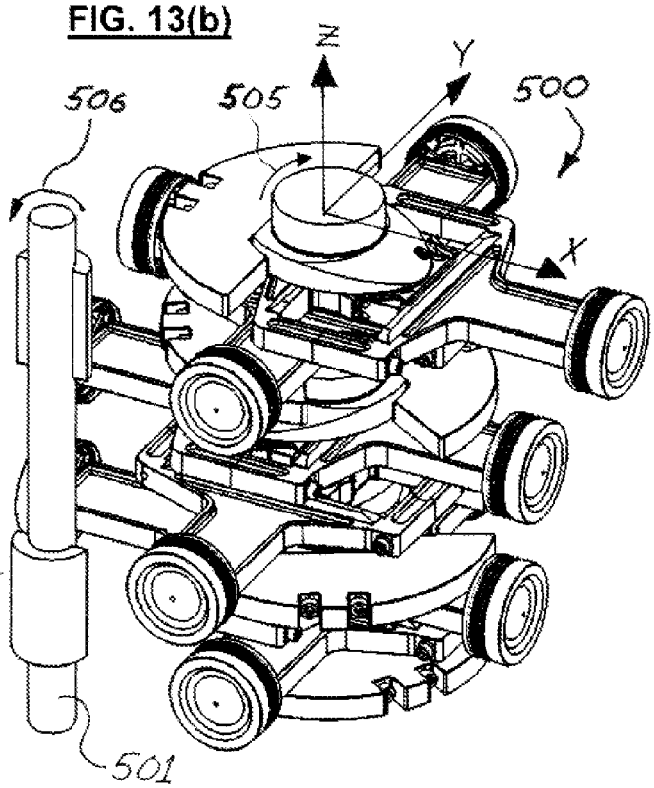
Figure 13C:
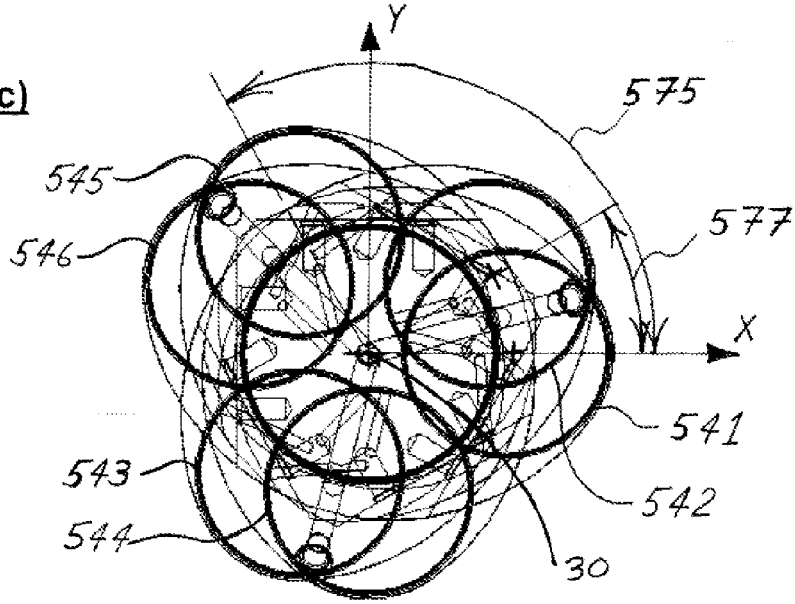
Figure 14A:
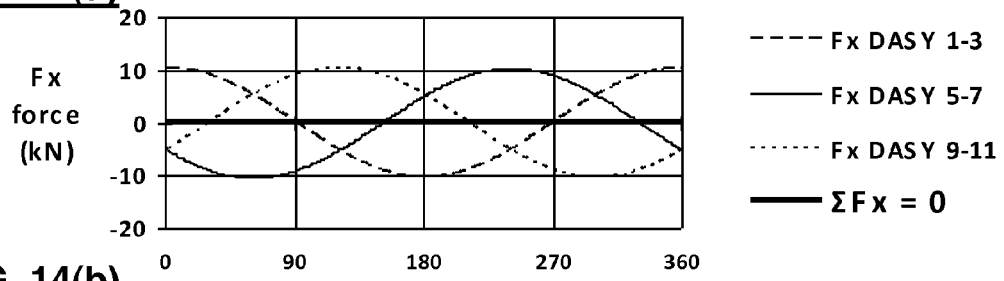
FIGS. 14(*a-e*) are graphical representations of the balance calculation results for the X-12 configuration for even-firing 4-stroke cycle.
Figure 14B:
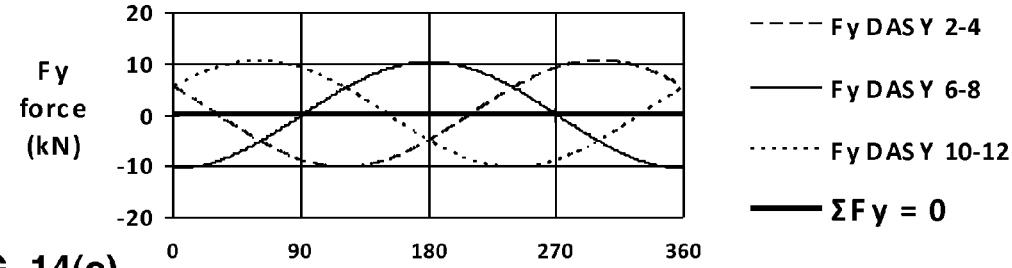
Figure 14C:
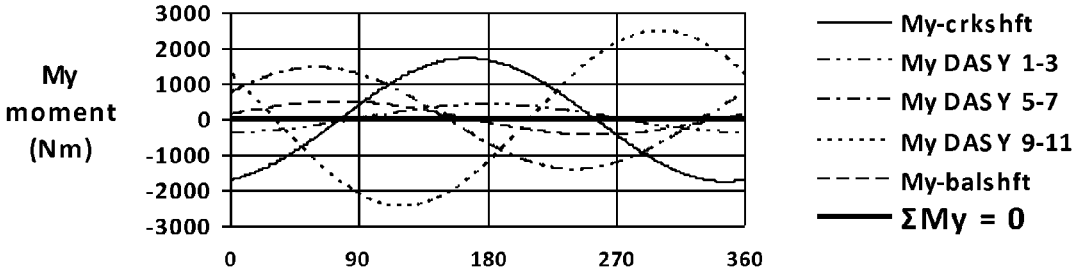
Figure 14D:
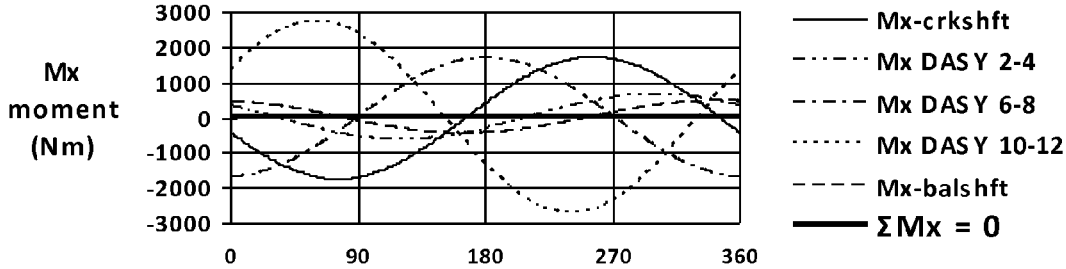
Figure 14E:
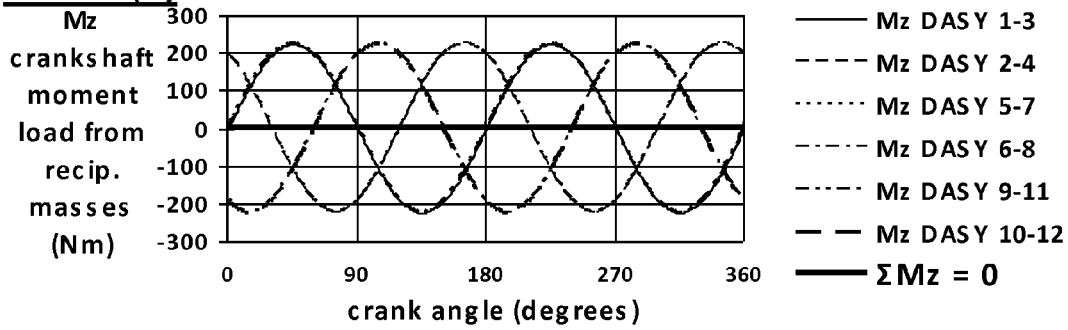

The DASY X-12 configuration for even-firing 4-stroke cycle is shown in FIGS. 13(*a*)-(*c*). In FIG. 13(*a*), the crankshaft 516, which has six crankpins 541, 542, 543, 544, 545, 546 is shown, and FIG. 13(*b*) is a view of the X-12 (4-stroke) crank train 500 showing the X-Y-Z coordinate system used in the balance calculation, and showing the balance shaft 501, and the crankshaft rotation direction 505 being clockwise looking down the z-axis, and the balance shaft rotation direction 506 being counter-clockwise. FIG. 13(*c*) is a top-hidden-line view of the crankshaft 516 (without the counterweights) showing that the six crankpins 541, 542, 543, 544, 545, 546, are arranged in three "split-pin" pairs, which are adjacent crankpins with angular offset relative to each other. The split-pin angle 577 is 30°, as shown in FIG. 13(*c*), makes two groups of three crankpins —541, 543, 545 and 542, 544, 546—each having a 120° mutual relative angle in between them as shown by feature 575, which is the angle 120° between crankpins 541 and 545. Crankpins 541, 543, 545 are each coupled to a single DASY 12, which moves on axes parallel to the x-axis, and crankpins 542, 544, 546 are each coupled to a single DASY 12, which moves on axes parallel to the y-axis. The upper "split-pin" crankpin 32 pair are engaged thusly: crankpin 541 has one reciprocating DASY assembly 12 coupled to it to engage cylinders 80 on banks 151 and 153, which are numbered cylinders #1 and #3, respectively. Crankpin 542 has one reciprocating DASY assembly 12 coupled to it to engage cylinders 80 on banks 152 and 154, which are numbered cylinders #2 and #4, respectively. The lower two split-pin crankpin pairs 543, 544 and 545, 546 engage the two lower X-4 groups in the same way as this for cylinders #5-#12.

The "split-pin" six-crankpin crankshaft allows for an even-firing 12-cylinders for the 4-stroke cycle having two cylinders at top-center for every 60° of crankshaft rotation. The engine bottom end assembly is similar to that shown in FIG. 5(*d*), except that there are three cylinders 80 on each of four banks of cylinders 151, 152, 153, 154.

Having the two sets of 120° spaced crankpins about the axis 30 results in the crankshaft being balanced for forces, but generating a rotating couple as the crankshaft rotates. However, unlike the previously described X-12 2-stroke case, this configuration requires a single counter-rotating $1^{st}$-order moment balance shaft 501 working in conjunction with the rotating moment generated by the crankshaft 516 in order to cancel out all moments and achieve perfect balance.

In FIGS. 14(*a*)-(*e*), the balance calculation analytical results for the X-12 engine crank train for even-firing 4-stroke cycle are shown. In FIG. 14(*a*), it can be seen that the forces from the three DASY reciprocating assemblies, which move in the x-axis direction, are canceling each other out, which results in $\Sigma Fx=0$ on a continuous basis, and the same result occurs for y-direction forces resulting in $\Sigma Fy=0$ continuously, as shown in FIG. 14(*b*). With regards to moments about the y-axis and the x-axis, in FIGS. 14(*c*) and (*d*), it can be seen that the crankshaft 516 moment working with the balance shaft 501 moment act to cancel out the moments generated by the DASYs so the result is $\Sigma My=0$ and $\Sigma Mx=0$ on a continuous basis. Lastly, in FIG. 14(*e*), the moment loading on the crankshaft as a result of the reciprocating masses acting on the crankpins as they move out of alignment with the centerline of the DASYs 33 is shown. The result is $\Sigma Mz=0$ on a continuous basis.

Thus, the DASY X-12 (4-stroke) is perfectly balanced using a single $1^{st}$-order balance shaft 501. While this embodiment defines one crankshaft configuration, there are four crankshaft configurations which can achieve even-firing 4-stroke cycle with perfect balance using a single balance shaft out of a total of 64 crankshaft configurations that have even-firing. There are 32 possible firing orders for each of the four crankshaft configurations for the even-fire 4-stroke X-12 with a single balance shaft and having perfect balance.

Figure 15A:
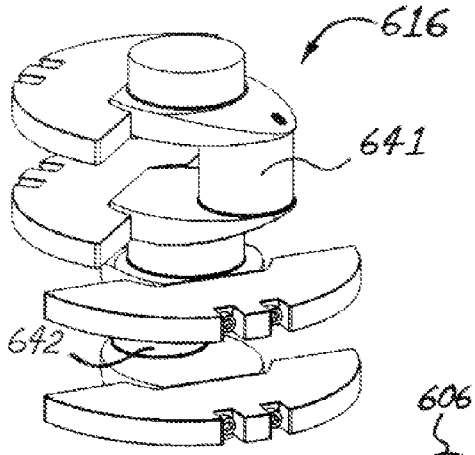
FIG. 15(*a*) is an isometric view of a crankshaft for the X-8 engine for even-firing 2-stroke cycle.
Figure 15B:
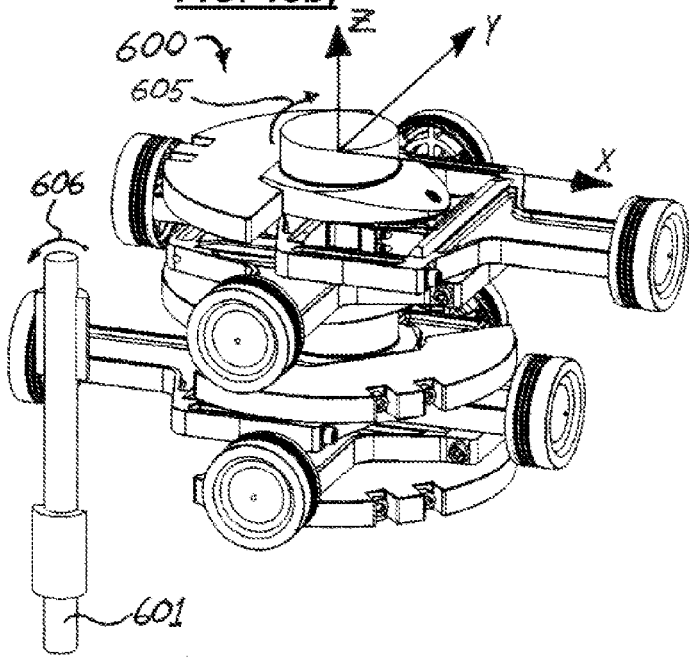
Figure 15C:
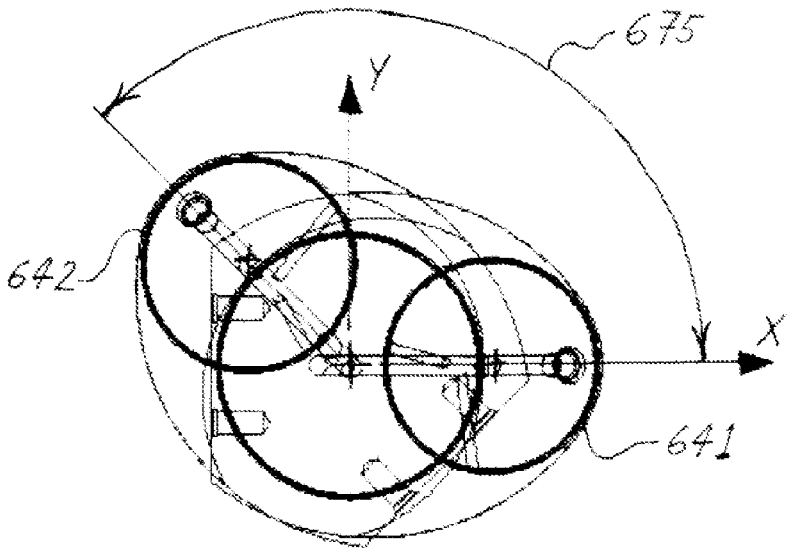
Figure 16A:
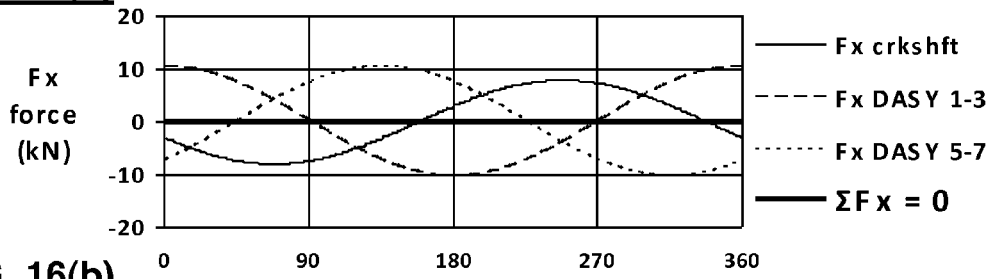
FIGS. 16(*a-e*) are graphical representations of the balance calculation results for the X-8 configuration for even-firing 2-stroke cycle.
Figure 16B:
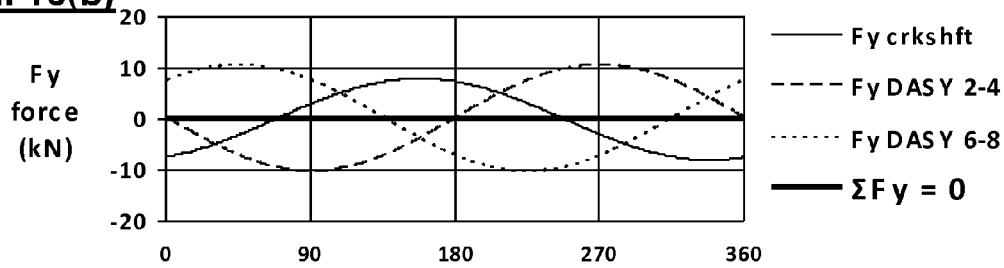
Figure 16C:
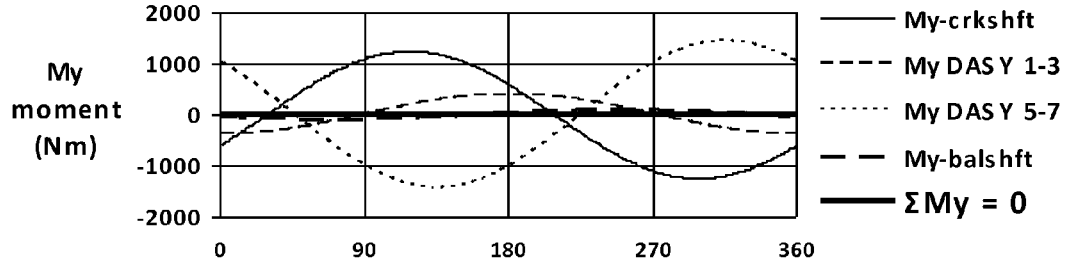
Figure 16D:
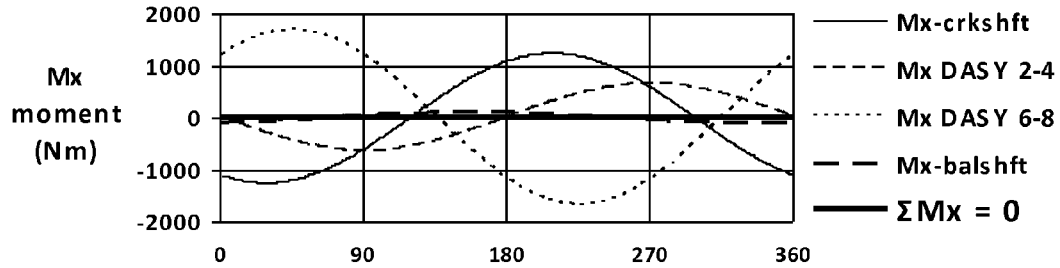
Figure 16E:
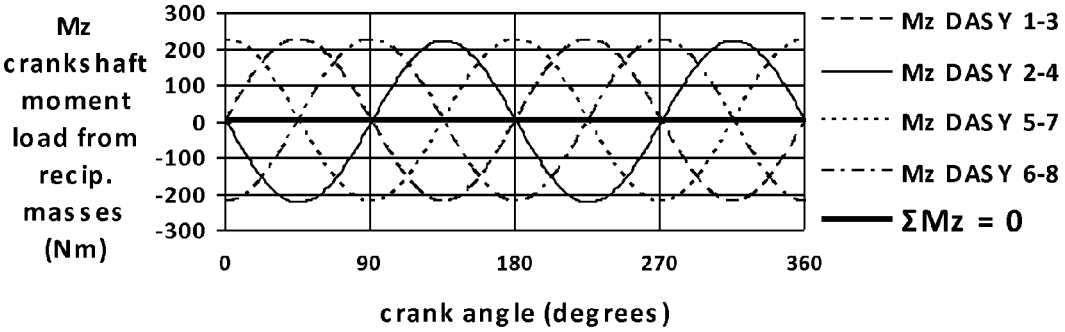
Figure 17A:
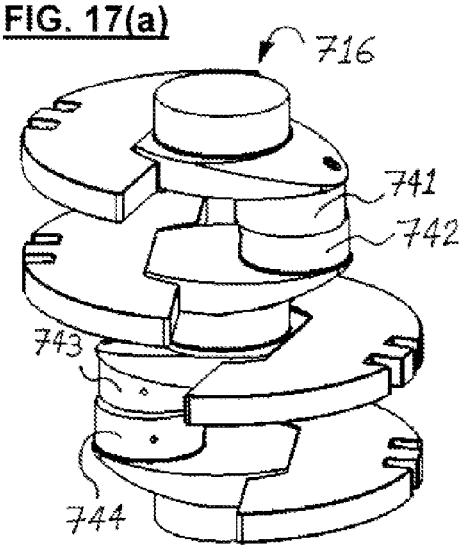
FIG. 17(*a*) is an isometric view of a crankshaft for the X-8 engine with a 75° X-angle for even-firing 4-stroke cycle.
Figure 17B:
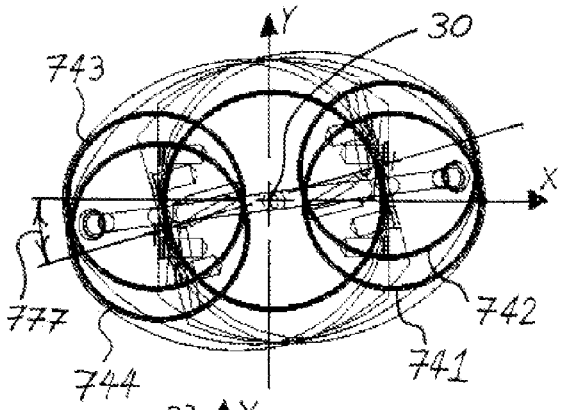
Figure 17C:
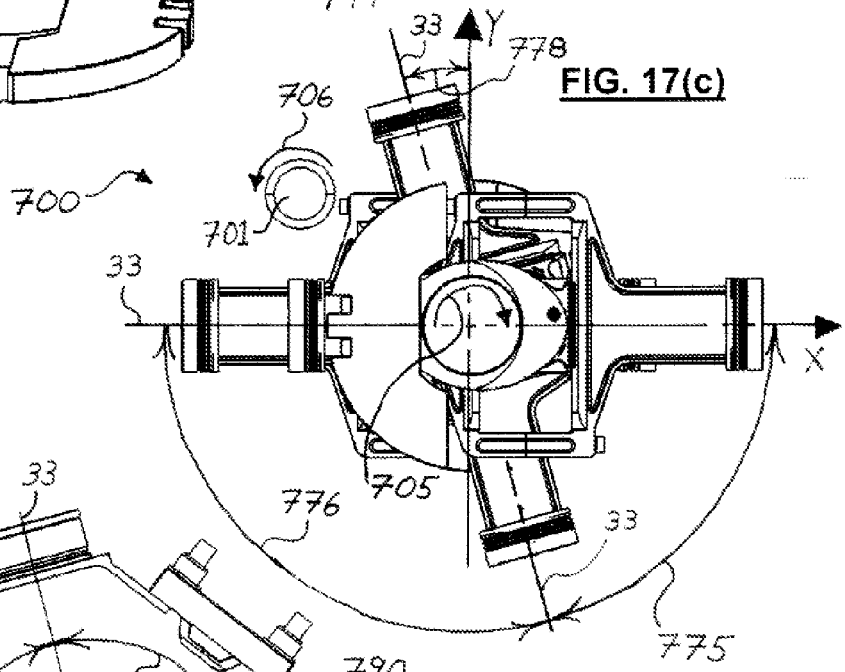
Figure 17D:
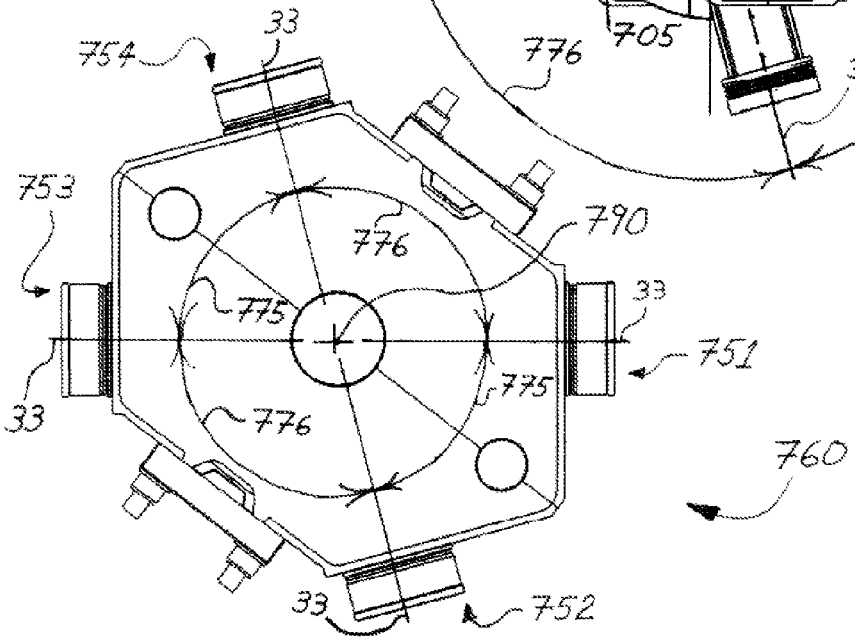
Figure 18A:
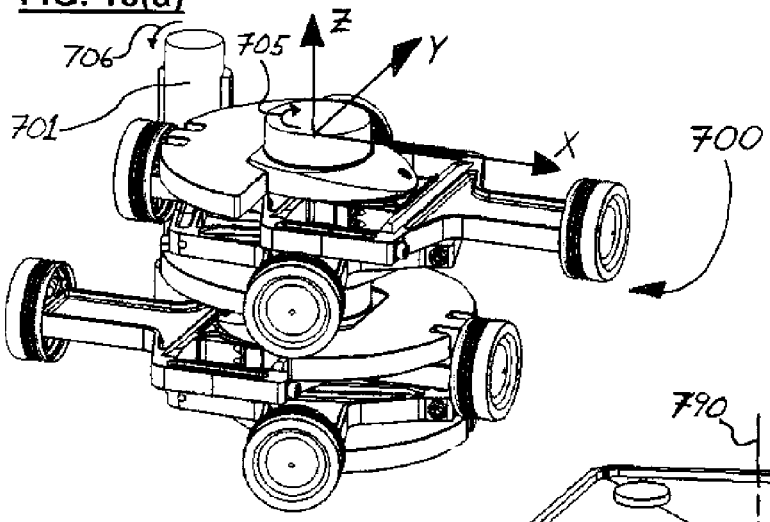
FIG. 18(*a*) is an isometric view of the X-8 crank train for the X-8 engine with a 75° X-angle for even-firing 4-stroke cycle with X-Y-Z coordinates used in the balance calculation analysis.
Figure 18B:
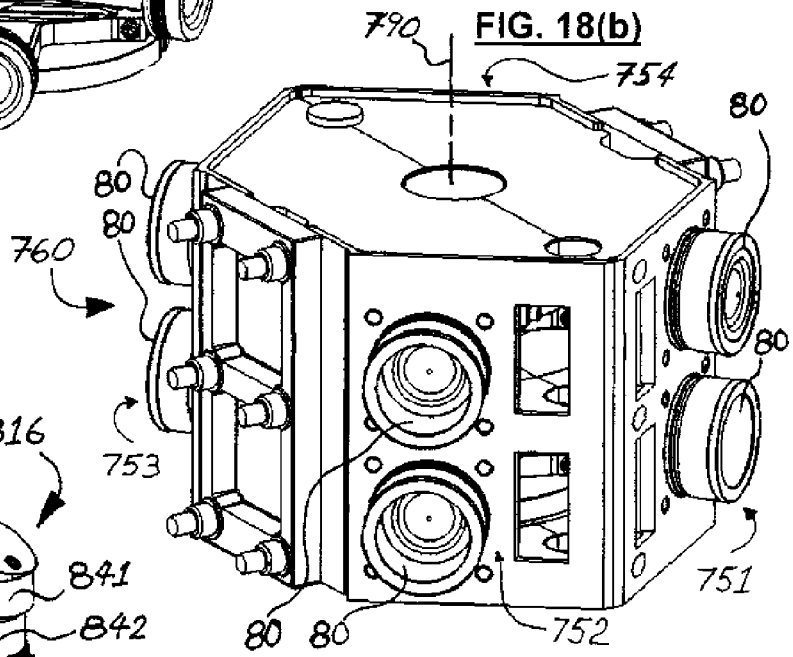
Figure 18C:
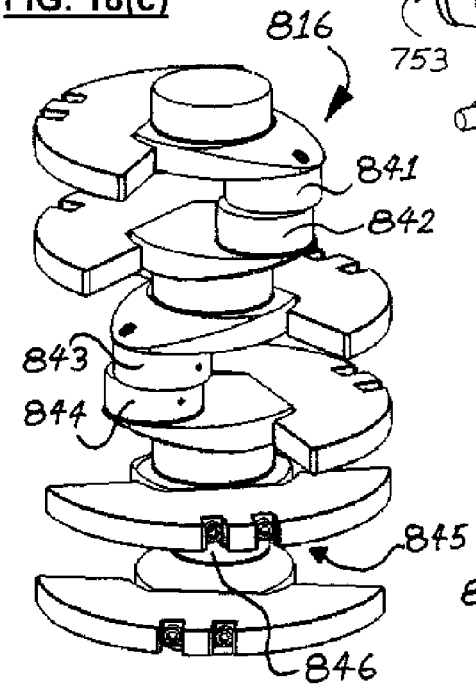
Figure 18D:
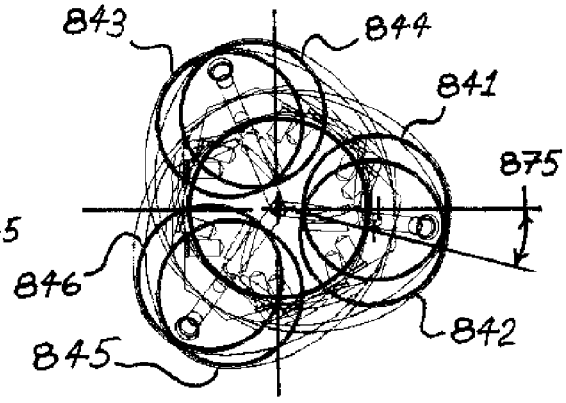
Figure 19A:
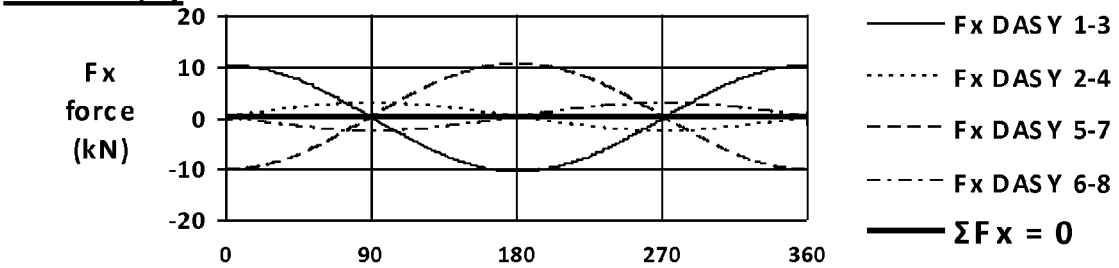
FIGS. 19(*a-e*) are graphical representations of the balance calculation results for the X-8 configuration with a 75° X-angle for even-firing 4-stroke cycle.
Figure 19B:
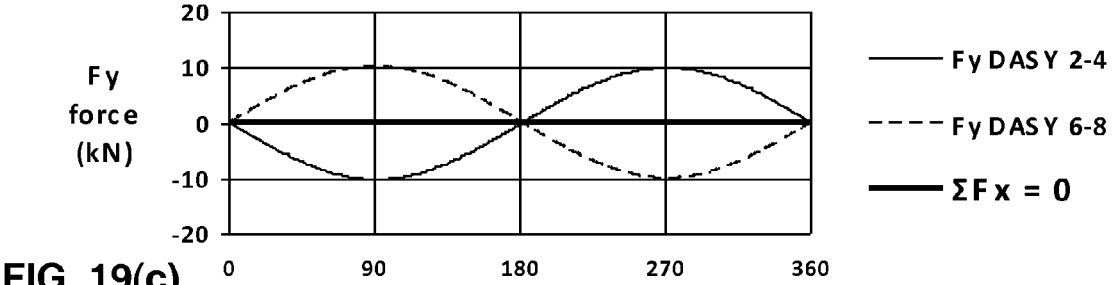
Figure 19C:
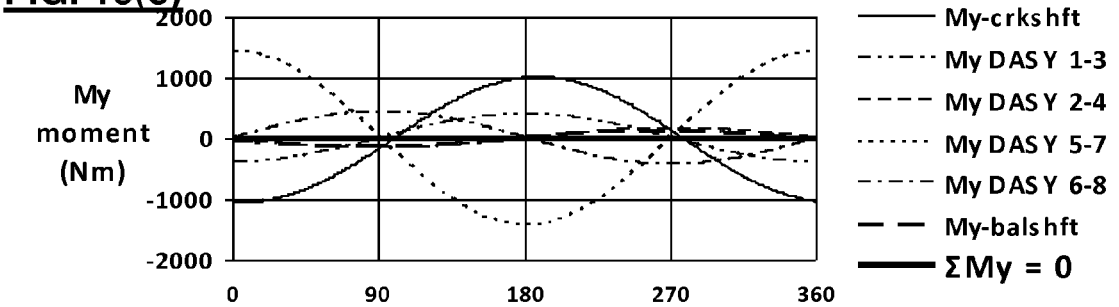
Figure 19D:
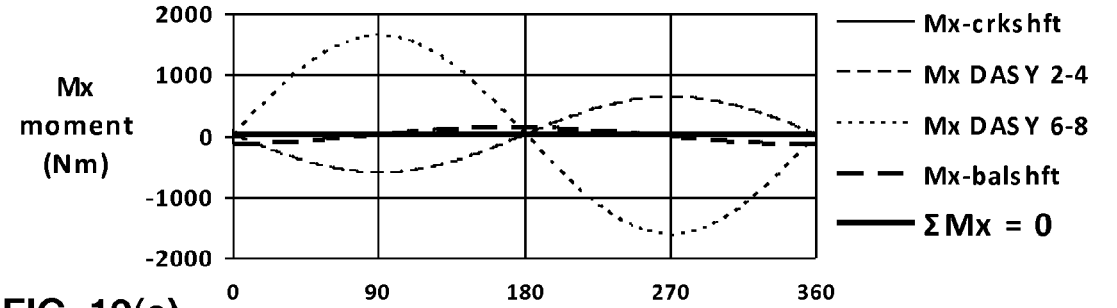
Figure 19E:
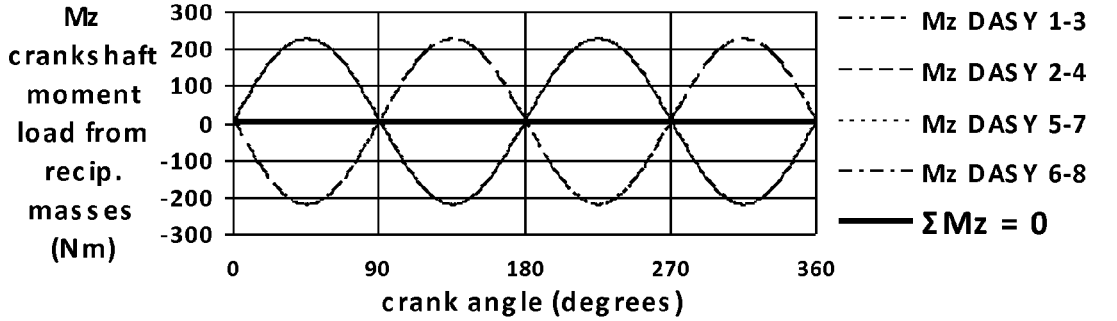
Figure 20A:
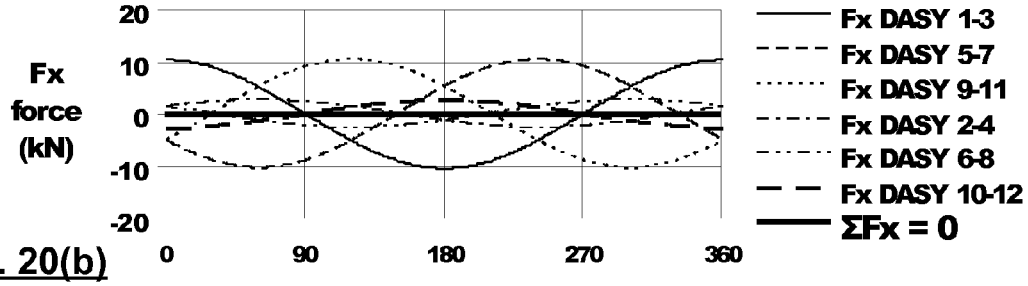
FIGS. 20(*a-e*) are graphical representations of the balance calculation results for the X-12 configuration with a 75° X-angle for even-firing 4-stroke cycle.
Figure 20B:
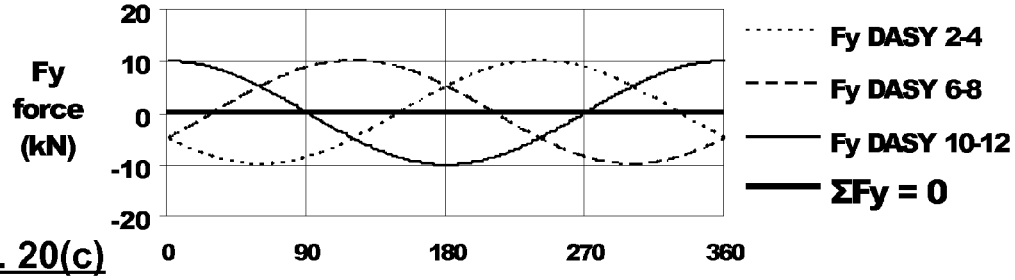
Figure 20C:
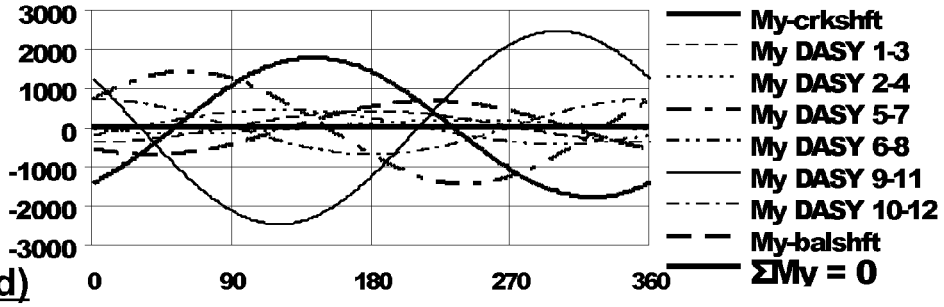
Figure 20D:
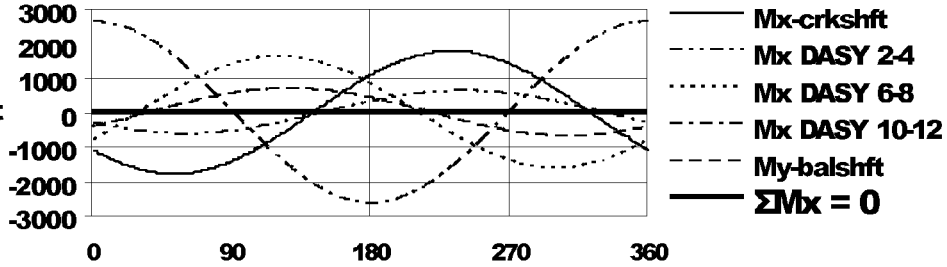
Figure 20E:
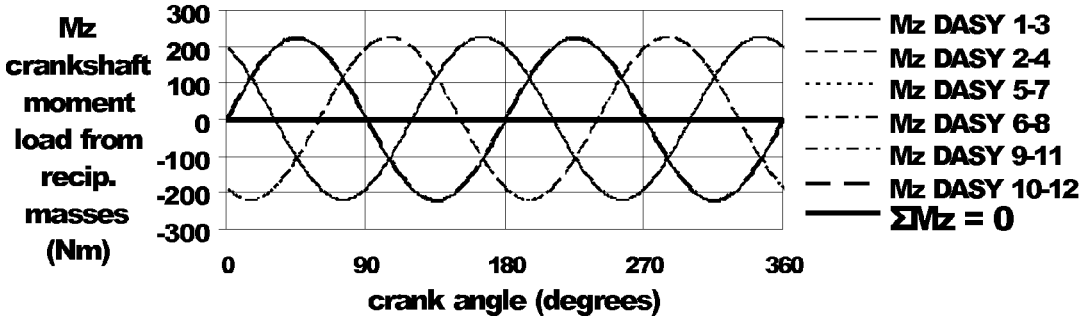

The DASY X-8 configuration for even-firing 2-stroke cycle is shown in FIGS. 15(*a*)-(*c*). In FIG. 15(*a*), the crankshaft 616, which has two crankpins 641, 642 is shown, and FIG. 15(*b*) is a view of the X-8 (2-stroke) crank train 600 showing the X-Y-Z coordinate system used in the balance calculation, and showing the balance shaft 601, and the crankshaft rotation direction 605 being clockwise looking down the z-axis, and the balance shaft rotation direction 606 being counter-clockwise. FIG. 15(*c*) is a top-hidden-line view of the crankshaft 616 (without the counterweights) showing that the two crankpins 641, 642, are arranged with an angular offset 675 of 135°. The engine bottom end assembly is similar to that shown in FIG. 5(*d*). Crankpin 641 has two reciprocating DASY assemblies 12 coupled to it to engage a cylinder 80 on each of the four banks 151, 152, 153, 154, with the cylinders being numbered #1, #2, #3, #4 corresponding to the cylinder banks 151, 152, 153, 154, respectively, and the lower crankpin 642 is also engaged with two reciprocating DASY assemblies 12 and is associated with the second group of four cylinders numbered #5, #6, #7, #8.

This two pin crankshaft allows for an even-firing 8-cylinders for the 2-stroke cycle having one cylinder at top-center for every 45° of crankshaft rotation.

Having the two crankpins configured with a un-even angular offset about the crankshaft axis 30 results in the crankshaft having a rotating moment as well as a rotating force. This rotating force acts to cancel out the forces resulting from the reciprocating DASY assemblies 12, whereas the crankshaft rotating moment, working in conjunction with the rotating moment from the single counter-rotating $1^{st}$-order moment balance shaft 601, act to cancel out all moments and achieve perfect balance.

In FIGS. 16(*a*)-(*e*), the balance calculation analytical results for the X-8 engine crank train for even-firing 2-stroke cycle are shown. In FIG. 16(*a*), it can be seen that the forces from the two DASY reciprocating assemblies which move in the x-axis direction and the x-direction component of the rotating force from the crankshaft, are canceling each other out, which results in $\Sigma Fx=0$ on a continuous basis, and the same result occurs for y-direction forces resulting in $\Sigma Fy=0$ continuously, as shown in FIG. 16(*b*). With regards to moments about the y-axis and the x-axis, in FIGS. 16(*c*) and (*d*), it can be seen that the crankshaft 616 moment working with the balance shaft 601 moment act to cancel out the moments generated by the DASYs so the result is $\Sigma My=0$ and $\Sigma Mx=0$ on a continuous basis. Lastly, in FIG. 16(*e*), the moment loading on the crankshaft as a result of the reciprocating masses acting on the crankpin as it moves out of alignment with the centerline of the DASY 33 is shown. The result is $\Sigma Mz=0$ on a continuous basis.

Thus, the DASY X-8 (2-stroke) is perfectly balanced using a single $1^{st}$ order balance shaft 601. While this embodiment defines one crankshaft configuration, there are four crankshaft configurations which can achieve even-firing 2-stroke cycle with perfect balance using a single balance shaft out of a total of four crankshaft configurations that have even-firing. There is one firing order for each of the four crankshaft configurations for the even-fire 2-stroke X-8 with perfect balance.

The DASY X-8 configuration for even-firing 4-stroke cycle and having a 75° X-angle (unlike previous configurations discussed which have a "90° X-angle") is shown in FIGS. 17(*a*)-(*d*) and FIGS. 18(*a*)-(*b*). In FIG. 17(*a*), the crankshaft 716, which has four crankpins 741, 742, 743, 744, is shown, and FIG. 17(*b*) is a top-hidden-line view of the crankshaft 716 (without the counterweights) showing that the four crankpins 741, 742, 743, 744, are arranged in two "split-pin" pairs, which are adjacent crankpins with angular offset relative to each other. The split-pin angle 777 is 15°, as shown in FIG. 17(*b*), which makes two groups of two crankpins —741, 743 and 742, 744—each having a 180° opposed relative angle in between them. Crankpins 741, 743 are each coupled to a single DASY 12, which moves on axes parallel to the x-axis, and crankpins 742, 744 are each coupled to a single DASY 12, which moves on axes which are on a plane that is angle 778 (FIG. 17(*c*)) which is a 15° angle, offset from a plane that intersects the crankshaft axis 30 and the y-axis. The upper "split-pin" crankpin pair are engaged thusly: crankpin 741 has one reciprocating DASY assembly 12 coupled to it to engage cylinders 80 on banks 751 and 753 of engine bottom end assembly 760 as shown in FIG. 17(*d*) and FIG. 18(*b*), which are numbered cylinders #1 and #3, respectively. Crankpin 742 has one reciprocating DASY assembly 12 coupled to it to engage cylinders 80 on banks 752 and 754, which are numbered cylinders #2 and #4, respectively. The lower split-pin crankpin pair 743, 744 engage the lower X-4 group in the same way as this for cylinders #5-#8.

The "split-pin" four-crankpin crankshaft allows for an even-firing 8-cylinders for the 4-stroke cycle having two cylinders at top-center for every 90° of crankshaft rotation. Crankshaft rotation 705 is clockwise with the balance shaft rotation 706 in the opposite direction as seen in FIG. 17(*c*) and FIG. 18(*a*). As shown in FIG. 17 (*d*), this X-engine configuration has an angle 775 which is a 75° angle between adjacent cylinder banks 751, 752 and 753, 754, and the other two sets of adjacent cylinder banks 752, 753 and 754, 751 are separated by angle 776 which is 105°. Having the two groups of 180°-opposed crankpins about the crankshaft axis 30 results in the crankshaft and the four reciprocating DASY assemblies 12 being balanced for forces as the crankshaft 716 rotates, but generating a rotating couple. The solution for achieving perfect balance is by having a counter-rotating $1^{st}$-order moment balance shaft 701 in order to cancel out all moments and achieve perfect balance.

In FIGS. 19(*a*)-(*e*), the balance calculation analytical results for the 75° X-8 engine crank train for even-firing 4-stroke cycle are shown. In FIG. 14(*a*), it can be seen that x-forces result from all DASY reciprocating assemblies 12 since they all have motion in the x-direction (unlike previously discussed cases with a 90° X-angle). These four x-forces are canceling each other out, which results in $\Sigma Fx=0$ on a continuous basis, and the same result occurs for y-direction forces resulting from two DASYs 12, hence $\Sigma Fy=0$ continuously, as shown in FIG. 19(*b*). With regards to moments about the y-axis and the x-axis, in FIGS. 14(*c*) and (*d*), it can be seen that the crankshaft 716 moment working with the counter-rotating balance shaft 701 moment act to cancel out the moments generated by the DASYs, so the result is $\Sigma My=0$ and $\Sigma Mx=0$ on a continuous basis. Lastly, in FIG. 14(*e*), the moment loading on the crankshaft is $\Sigma Mz=0$ on a continuous basis. Thus, the DASY X-8 even-firing 4-stroke engine with 75° X-angle is perfectly balanced using a single counter-rotating $1^{st}$-order moment-balance shaft 701.

The DASY X-12 configuration for even-firing 4-stroke cycle and having a 75° X-angle has a crankshaft 816 shown in FIG. 18(*c*) and FIG. 18(*d*) which is a top-hidden-line view of the crankshaft 816 (without the counterweights). The engine bottom end assembly is the same as the 75° X-8 configuration 760 shown in FIG. 17(*d*) and FIG. 18(*b*) except there are three cylinders 80 on each cylinder bank 751-754, and the crank train assembly is similar to 700 shown in FIG. 17(*c*) and FIG. 18(*a*) except there are six crankpins instead of four and six DASYs instead of four, and with the crankpins having different angular spacing. The six crankpins 841, 842, 843, 844, 845, 846 are arranged in three "split-pin" pairs, which are adjacent crankpins with the split-pin angle 875 being 15°, as shown in FIG. 18(*d*), which makes two groups of three crankpins —841, 843, 845 and 842, 844, 846—with each group having a 120° mutual spacing between crankpins. Crankpins 841, 843, 845 are each coupled to a single DASY 12, which moves on axes parallel to the x-axis, and crankpins 842, 844,

846 are each coupled to a single DASY 12, which moves on axes which are on a plane that is angle 778 (FIG. 17(*c*)) which is 15° offset from the y-axis. The upper "split-pin" crankpin 32 pair are engaged in the same way as previously described for the 75° X-8, for cylinders #1-#4, and the lower two split-pin crankpin pairs 843, 844 and 845, 846 engage the two lower X-4 groups in the same way as this for cylinders #5-#12.

The "split-pin" six-crankpin crankshaft allows for an even-firing 12-cylinders for the 4-stroke cycle having two cylinders at top-center for every 60° of crankshaft rotation. Having the two groups of three 120° mutually spaced crankpins about the axis 30 results in the crankshaft and the six reciprocating DASY assemblies 12 being balanced for forces, but generating a rotating couple as the crankshaft rotates. The solution for achieving perfect balance is by having a rotating couple generated by a single counter-rotating $1^{st}$-order moment-balance shaft 701 in order to cancel out all moments and achieve perfect balance.

In FIGS. 20(*a*)-(*e*), the balance calculation analytical results for the 75° X-12 engine crank train for even-firing 4-stroke cycle are shown. In FIG. 14(*a*), it can be seen that x-forces result from all six DASY reciprocating assemblies 12 since they all have motion in the x-direction unlike X-engines with 90° X-angles. These six x-forces are canceling each other out, which results in $\Sigma Fx=0$ on a continuous basis, and the same result occurs for y-direction forces resulting from three DASYs 12, hence $\Sigma Fy=0$ continuously, as shown in FIG. 19(*b*). With regards to moments about the y-axis and the x-axis, in FIGS. 14(*c*) and (*d*), it can be seen that the crankshaft 816 moment working with the balance shaft 701 moment act to cancel out the moments generated by the DASYs, so the result is $\Sigma My=0$ and $\Sigma Mx=0$ on a continuous basis. Lastly, in FIG. 14(*e*), the moment loading on the crankshaft is $\Sigma Mz=0$ on a continuous basis. Thus, the DASY X-12 (4-stroke) with 75° X-angle is perfectly balanced using a single $1^{st}$-order counter-rotating moment-balance shaft 701.

To conclude, for even-firing 4-stroke engines with eight cylinders and above (X-8, X-12, X-16, X-20, etc.), and for even-firing 2-stroke engines from four cylinders and above (X-4, X-8, X-12, X-16, etc.), and other cycles such as the "split-cycle" from eight cylinders and above (X-8, X-16, X-24, etc.), there is a DASY X-engine configuration which can achieve perfect balance, zero torsional acceleration of the crankshaft resulting from reciprocating masses, with perfect balance being achieved either inherently (with no additional balancing mechanisms) or using a single $1^{st}$-order counter-rotating moment-balance shaft mounted parallel to the crankshaft axis. In the case of even-firing 4-stroke cycle engines, the X-angle can be 90° or non-90°.

Having described presently preferred embodiments the invention may be otherwise embodied within the scope of the appended claims.

What is claimed is:

1. An X-Engine assembly, comprising:

four cylinder banks arranged around a central crankshaft, the cylinder banks lying in two perpendicular planes with a crankshaft axis being on a line which is the intersection of the two planes; and having two or more cylinders on each cylinder bank with each cylinder bank having the same number of cylinders; and having the central crankshaft with two or more crankpins with the crankpins configured as one or more groups of evenly-spaced angular arrays about the crankshaft axis; and having the crankpins angularly arranged for even-firing four-stroke cycle; and having two reciprocating assemblies coupled to each crankpin of the crankshaft; and having each reciprocating assembly coupled to each crankpin on the crankshaft in such a way that, as the crankshaft rotates, the reciprocating assembly moves in reciprocating-sinusoidal-linear motion and the crankshaft generates a rotating moment; and having an outward-facing piston at both ends of each reciprocating assembly with each piston coaxially engaged with a cylinder of a cylinder bank; and having the reciprocating assemblies being offset relative to each other along the crankshaft axis; and having the four pistons of the two reciprocating assemblies that are coupled to each crankpin engaged with a cylinder of each of the four cylinder banks, wherein the rotating moment generated by the crankshaft cancels out vibration moments generated by the reciprocating assemblies, thereby resulting in the X-engine assembly having perfect balance for forces and moments during operation without the use of a balancing mechanism.

2. The assembly according to claim 1, wherein the crankshaft comprises an even number of crankpins having one or more pairs of crankpins, and wherein the crankpins of each pair of crankpins are angularly displaced by 180° relative to each other about the crankshaft axis.

3. The assembly according to claim 2, wherein the X-engine assembly comprises eight cylinders, and wherein the crankshaft comprises one pair of crankpins.

4. The assembly according to claim 2, wherein the X-engine assembly comprises 16 cylinders, and wherein the crankshaft comprises two pairs of crankpins with each pair of crankpins defining a plane that intersects the crankshaft axis with a forty-five degree angle of intersection between the two pairs of crankpins.

5. An X-Engine assembly, comprising:

four cylinder banks arranged around a central crankshaft, the cylinder banks lying in two perpendicular planes with a crankshaft axis being on a line which is the intersection of the two planes; and having three or more cylinders on each cylinder bank with each cylinder bank having the same number of cylinders; and having the central crankshaft comprising the same number of crankpins as the number of cylinders on each cylinder bank; and having the crankpins configured in an evenly-spaced angular array for even-firing two-stroke cycle; and having two reciprocating assemblies coupled to each crankpin of the crankshaft; and having each reciprocating assembly coupled to the crankpin on the crankshaft in such a way that, as the crankshaft rotates, the reciprocating assembly moves in reciprocating-sinusoidal-linear motion and the crankshaft generates a rotating moment; and having an outward-facing piston at both ends of each reciprocating assembly with each piston coaxially engaged with a cylinder of a cylinder bank; and having the reciprocating assemblies being offset relative to each other along the crankshaft axis; and having pistons of the two reciprocating assemblies that are coupled to each crankpin engaged with a cylinder of each of the four cylinder banks, wherein the rotating moment generated by the crankshaft cancels out vibration moments generated by the reciprocating assemblies, thereby resulting in the X-engine assembly having perfect balance for forces and moments during operation without the use of a balancing mechanism.

6. The assembly according to claim 5, wherein the X-engine assembly comprises 12 cylinders, and wherein the crankshaft comprises three crankpins.

7. An X-Engine assembly, comprising:

four cylinder banks arranged around a central crankshaft, the cylinder banks lying in two intersecting planes with a crankshaft axis being on a line which is the intersection of the two planes; and having two or more cylinders on each cylinder bank with each cylinder bank having the same number of cylinders; and having the central crankshaft comprising two or more pairs of crankpins, wherein each pair of crankpins is angularly separated about the crankshaft axis by a common angle; and having the crankpins angularly arranged to provide even-firing for four-stroke cycle; and having a plurality of reciprocating assemblies coupled to the crankshaft, wherein one reciprocating assembly is coupled to each crankpin of the crankshaft; and having each reciprocating assembly coupled to each crankpin on the crankshaft in such a way that, as the crankshaft rotates, the reciprocating assembly moves in reciprocating-sinusoidal-linear motion and the crankshaft generates a rotating moment; and having an outward-facing piston at both ends of each reciprocating assembly with each piston coaxially engaged with a cylinder of a cylinder bank; and having pistons of the two reciprocating assemblies that are coupled to each pair of crankpins engaged with a cylinder of each of the four cylinder banks; and having each reciprocating assembly offset relative to each other along the crankshaft axis; and having a balance shaft which is mounted in the X-engine structure on an axis parallel to the crankshaft axis and which generates a rotating moment as the balance shaft rotates in an opposite direction and at the same angular velocity as the crankshaft, wherein the rotating moments generated by the balance shaft and the crankshaft cancel out vibration moments generated by the reciprocating assemblies, thereby resulting in the X-engine assembly having perfect balance for forces and moments during operation.

8. The assembly according to claim 7, wherein the X-Engine assembly comprises 12 cylinders, and wherein the four banks of cylinders lie in two perpendicular planes.

9. The assembly according to claim 7, wherein the X-Engine assembly comprises eight cylinders, and wherein the four banks of cylinders lie in two non-perpendicular planes.

10. The assembly according to claim 7, wherein the X-Engine assembly comprises 12 cylinders, and wherein the four banks of cylinders lie in two non-perpendicular planes.

* * * * *